US006785946B2

(12) United States Patent
Romme et al.

(10) Patent No.: US 6,785,946 B2
(45) Date of Patent: Sep. 7, 2004

(54) SYSTEM AND METHOD FOR REFILLING A DISPENSER

(75) Inventors: Steven John Romme, Oshkosh, WI (US); William Robert Newman, Neenah, WI (US); Herb F. Velazquez, Neenah, WI (US); Ligia A. Rivera, Appleton, WI (US); Michael John Faulks, Neenah, WI (US); Paige Annette Dellerman, Appleton, WI (US); Cherry A. Bochmann, Cleveland, OH (US); Nick E. Stanca, Westlake, OH (US); Gerald P. DeGreen, Windsor, OH (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 89 days.

(21) Appl. No.: 09/844,731

(22) Filed: Apr. 27, 2001

(65) Prior Publication Data

US 2002/0005452 A1 Jan. 17, 2002

Related U.S. Application Data

(63) Continuation of application No. 09/660,049, filed on Sep. 12, 2000, which is a continuation-in-part of application No. 09/565,227, filed on May 4, 2000, which is a continuation-in-part of application No. 09/545,995, filed on Apr. 10, 2000.

(60) Provisional application No. 60/132,024, filed on Apr. 30, 1999.

(51) Int. Cl.[7] ..... B23Q 17/00; B65H 18/04

(52) U.S. Cl. ..... 29/407.01; 242/598.6; 242/595

(58) Field of Search ..... 29/407.01, 407.09, 29/407.1; 242/598.6, 594, 594.5, 595; 221/45, 46, 49; 206/494, 812, 233, 204; D6/518, 522

(56) References Cited

U.S. PATENT DOCUMENTS

| | | | |
|---|---|---|---|
| 1,664,392 | A | 4/1928 | Baruch |
| 2,440,974 | A | 5/1948 | Resch |
| 3,310,353 | A | 3/1967 | Cordis |
| 3,368,522 | A | 2/1968 | Cordis |
| 3,532,210 | A | 10/1970 | Minion et al. |
| 3,568,635 | A | 3/1971 | Poitras et al. |
| 3,592,161 | A | 7/1971 | Hoffmann |
| 3,603,519 | A | 9/1971 | Brown |
| 3,633,838 | A | 1/1972 | Krueger |
| 3,656,699 | A | 4/1972 | Schnyder et al. |

(List continued on next page.)

FOREIGN PATENT DOCUMENTS

| | | |
|---|---|---|
| EP | 0 251 103 A1 | 1/1988 |
| EP | 1 023 863 A1 | 8/2000 |
| EP | 1 048 257 A2 | 11/2000 |
| EP | 1 048 257 A3 | 11/2000 |

(List continued on next page.)

OTHER PUBLICATIONS

Search Report for Patent Cooperation Treaty application No. PCT/US 01/11195, Date of Mailing Jul. 19, 2001, 7 pages.
Search Report for Patent Cooperation Treaty application No. PCT/US 01/11198, Date of Mailing Jul. 19, 2001, 7 pages.
Search Report for Patent Cooperation Treaty application No. PCT/US 01/11620, Date of Mailing Jul. 19, 2001, 7 pages.

(List continued on next page.)

*Primary Examiner*—David P. Bryant
(74) *Attorney, Agent, or Firm*—Brinks Hofer Gilson & Lione

(57) ABSTRACT

There is provided a method for refilling a system and apparatus for dispensing wet wipes. The system may include a housing, a tray and a cartridge. The cartridge has the ability to be inserted into the dispenser in a pre-selected manner based on the desired orientation of the wipes contained therein.

4 Claims, 28 Drawing Sheets

U.S. PATENT DOCUMENTS

| | | | | |
|---|---|---|---|---|
| 3,713,170 | A | | 1/1973 | Kaufman |
| 3,729,145 | A | | 4/1973 | Koo et al. |
| 3,754,804 | A | | 8/1973 | Cushman |
| 3,756,483 | A | | 9/1973 | Schraeder |
| 3,771,739 | A | | 11/1973 | Nelson |
| 3,775,801 | A | | 12/1973 | Walker |
| 3,780,908 | A | | 12/1973 | Fitzpatrick et al. |
| 3,784,055 | A | | 1/1974 | Anderson |
| 3,788,573 | A | | 1/1974 | Thomson et al. |
| 3,795,355 | A | | 3/1974 | Gerstein |
| 3,799,467 | A | * | 3/1974 | Bauman ..... 242/595 |
| 3,806,055 | A | | 4/1974 | Bauman |
| 3,824,953 | A | | 7/1974 | Boone |
| 3,836,044 | A | | 9/1974 | Tilp et al. |
| 3,836,045 | A | | 9/1974 | Duhy et al. |
| 3,837,595 | A | | 9/1974 | Boone |
| 3,841,466 | A | | 10/1974 | Hoffman et al. |
| 3,843,017 | A | | 10/1974 | Harrison |
| 3,848,822 | A | | 11/1974 | Boone |
| 3,865,271 | A | | 2/1975 | Gold |
| 3,890,622 | A | | 6/1975 | Alden |
| 3,913,522 | A | | 10/1975 | Light |
| 3,943,859 | A | | 3/1976 | Boone |
| 3,949,947 | A | | 4/1976 | Youngquist et al. |
| 3,967,756 | A | | 7/1976 | Barish |
| 3,970,215 | A | | 7/1976 | McLaren et al. |
| 3,982,659 | A | | 9/1976 | Ross |
| 3,986,479 | A | | 10/1976 | Bonk |
| 3,994,417 | A | | 11/1976 | Boedecker |
| 3,995,582 | A | | 12/1976 | Douglas |
| 4,002,264 | A | | 1/1977 | Marchesani |
| 4,004,687 | A | | 1/1977 | Boone |
| 4,025,004 | A | | 5/1977 | Massey |
| 4,043,519 | A | | 8/1977 | Suzuki et al. |
| 4,069,789 | A | | 1/1978 | Fukagawa et al. |
| 4,071,200 | A | | 1/1978 | Stone |
| 4,098,469 | A | | 7/1978 | McCarthy |
| 4,101,026 | A | | 7/1978 | Bonk |
| 4,106,433 | A | | 8/1978 | Fernando et al. |
| 4,106,616 | A | | 8/1978 | Boone |
| 4,106,617 | A | | 8/1978 | Boone |
| 4,114,824 | A | | 9/1978 | Danielak |
| 4,124,259 | A | | 11/1978 | Harris |
| 4,131,195 | A | | 12/1978 | Worrell, Sr. |
| 4,135,199 | A | | 1/1979 | Kurland et al. |
| 4,135,678 | A | | 1/1979 | Williams |
| 4,138,034 | A | | 2/1979 | McCarthy |
| 4,179,078 | A | | 12/1979 | Mansfield |
| 4,191,317 | A | | 3/1980 | Harkins |
| 4,205,802 | A | | 6/1980 | Economakis |
| 4,219,129 | A | | 8/1980 | Sedwick |
| 4,222,621 | A | | 9/1980 | Greenlee et al. |
| 4,235,333 | A | | 11/1980 | Boone |
| 4,244,493 | A | | 1/1981 | Harrison |
| 4,260,117 | A | | 4/1981 | Perrin et al. |
| 4,274,573 | A | | 6/1981 | Finkelstein |
| 4,294,389 | A | | 10/1981 | Falk et al. |
| 4,328,907 | A | | 5/1982 | Beard |
| 4,353,480 | A | | 10/1982 | McFadyen |
| 4,363,454 | A | | 12/1982 | Mohar |
| 4,375,874 | A | | 3/1983 | Leotta et al. |
| 4,383,656 | A | | 5/1983 | Campbell |
| 4,401,248 | A | | 8/1983 | Helms |
| 4,411,374 | A | | 10/1983 | Hotchkiss |
| 4,425,012 | A | | 1/1984 | Kley |
| 4,427,159 | A | | 1/1984 | Miller et al. |
| 4,428,497 | A | | 1/1984 | Julius et al. |
| 4,432,504 | A | | 2/1984 | Pace |
| 4,436,221 | A | | 3/1984 | Margulies |
| 4,447,015 | A | | 5/1984 | Peterson |
| 4,453,634 | A | | 6/1984 | Blumenthal |
| 4,463,912 | A | | 8/1984 | Grunerud |
| 4,467,974 | A | | 8/1984 | Crim |
| 4,526,291 | A | | 7/1985 | Margulies |
| 4,535,912 | A | | 8/1985 | Bonk |
| 4,550,855 | A | | 11/1985 | Harrison |
| 4,564,148 | A | | 1/1986 | Wentworth |
| 4,566,606 | A | | 1/1986 | Kling |
| 4,570,820 | A | | 2/1986 | Murphy |
| 4,601,938 | A | | 7/1986 | Deacon et al. |
| 4,607,809 | A | | 8/1986 | Sineni et al. |
| 4,648,530 | A | | 3/1987 | Granger |
| 4,659,028 | A | | 4/1987 | Wren |
| 4,662,576 | A | | 5/1987 | Paul |
| 4,662,577 | A | | 5/1987 | Lewis |
| 4,667,890 | A | | 5/1987 | Gietman, Jr. |
| 4,684,075 | A | | 8/1987 | Francis |
| 4,690,345 | A | | 9/1987 | Cotey |
| 4,721,264 | A | | 1/1988 | Muscarello |
| 4,735,317 | A | | 4/1988 | Sussman et al. |
| 4,756,485 | A | | 7/1988 | Bastian et al. |
| 4,775,109 | A | | 10/1988 | Tegg |
| 4,784,290 | A | | 11/1988 | Howard |
| 4,790,490 | A | | 12/1988 | Chakravorty |
| 4,807,823 | A | | 2/1989 | Wyant |
| 4,826,063 | A | | 5/1989 | Ban |
| 4,828,193 | A | | 5/1989 | Galbraith |
| 4,830,301 | A | | 5/1989 | Miller |
| 4,834,316 | A | | 5/1989 | DeLorean |
| 4,836,368 | A | | 6/1989 | Cotton |
| 4,836,462 | A | | 6/1989 | Bruss |
| 4,846,412 | A | | 7/1989 | Morand |
| 4,860,893 | A | | 8/1989 | Kaufman |
| D303,890 | S | | 10/1989 | Pilot |
| 4,877,133 | A | | 10/1989 | Klenter et al. |
| 4,883,197 | A | | 11/1989 | Sanchez et al. |
| 4,884,690 | A | | 12/1989 | Klenter et al. |
| 4,890,205 | A | | 12/1989 | Shaffer |
| 4,913,365 | A | | 4/1990 | Shamass |
| 4,936,452 | A | | 6/1990 | Pauley |
| D311,106 | S | | 10/1990 | Jaber |
| 4,978,095 | A | | 12/1990 | Phillips |
| 4,984,530 | A | | 1/1991 | Dutton |
| 4,989,800 | A | | 2/1991 | Tritch |
| 4,991,538 | A | | 2/1991 | Davids et al. |
| 5,000,393 | A | | 3/1991 | Madsen |
| 5,009,313 | A | | 4/1991 | Morand |
| 5,012,986 | A | | 5/1991 | Needle |
| 5,029,787 | A | | 7/1991 | Florentin |
| 5,049,440 | A | | 9/1991 | Bornhoeft, III et al. |
| 5,050,737 | A | | 9/1991 | Joslyn et al. |
| 5,104,054 | A | | 4/1992 | Latham |
| 5,137,173 | A | | 8/1992 | Hughes et al. |
| 5,141,171 | A | | 8/1992 | Yang |
| 5,145,091 | A | | 9/1992 | Meyers |
| D329,978 | S | | 10/1992 | Ryan |
| 5,154,496 | A | | 10/1992 | Campbell et al. |
| 5,170,958 | A | | 12/1992 | Brown |
| 5,172,840 | A | | 12/1992 | Bloch et al. |
| 5,192,044 | A | | 3/1993 | Baskin |
| 5,193,759 | A | | 3/1993 | Bigelow et al. |
| 5,195,689 | A | | 3/1993 | Beer et al. |
| 5,207,367 | A | | 5/1993 | Dunn et al. |
| 5,219,092 | A | | 6/1993 | Morand |
| 5,228,632 | A | | 7/1993 | Addison et al. |
| 5,253,818 | A | | 10/1993 | Craddock |
| 5,255,800 | A | | 10/1993 | Kelly |
| D342,635 | S | | 12/1993 | Carter et al. |
| D342,852 | S | | 1/1994 | Welch |
| 5,277,375 | A | | 1/1994 | Dearwester |
| 5,310,262 | A | | 5/1994 | Robison et al. |

| | | | |
|---|---|---|---|
| 5,311,986 | A | 5/1994 | Putz |
| 5,312,883 | A | 5/1994 | Komatsu et al. |
| 5,317,063 | A | 5/1994 | Komatsu et al. |
| D347,534 | S | 6/1994 | Gottselig |
| 5,335,811 | A | 8/1994 | Morand |
| 5,368,157 | A | 11/1994 | Gasparrini et al. |
| 5,370,336 | A | 12/1994 | Whittington |
| 5,374,008 | A | 12/1994 | Halvorson et al. |
| 5,384,189 | A | 1/1995 | Kuroda et al. |
| 5,392,945 | A | 2/1995 | Syrek |
| 5,400,982 | A | 3/1995 | Collins |
| 5,409,181 | A | 4/1995 | Patrick |
| 5,439,521 | A | 8/1995 | Rao |
| 5,443,084 | A | 8/1995 | Saleur |
| 5,449,127 | A | 9/1995 | Davis |
| D362,773 | S | 10/1995 | Kartchner |
| 5,456,420 | A | 10/1995 | Frazier |
| 5,456,421 | A | 10/1995 | Reed |
| 5,462,197 | A | 10/1995 | Pound |
| 5,464,096 | A | 11/1995 | Hurwitz |
| 5,464,170 | A | 11/1995 | Mitchell et al. |
| 5,480,060 | A | 1/1996 | Blythe |
| 5,494,250 | A | 2/1996 | Chen |
| 5,495,997 | A | 3/1996 | Moody |
| 5,501,323 | A | 3/1996 | Denesha et al. |
| 5,509,593 | A | 4/1996 | Bloch et al. |
| 5,520,308 | A | 5/1996 | Berg, Jr. et al. |
| 5,526,973 | A | 6/1996 | Boone et al. |
| 5,533,621 | A | 7/1996 | Schoal, Jr. |
| 5,540,332 | A | 7/1996 | Kopacz et al. |
| 5,542,568 | A | 8/1996 | Julius |
| 5,560,514 | A | 10/1996 | Frazier |
| 5,588,615 | A | 12/1996 | Batts |
| D377,284 | S | 1/1997 | Farrow et al. |
| 5,598,987 | A | 2/1997 | Wachowicz |
| 5,604,992 | A | 2/1997 | Robinson |
| 5,605,250 | A | 2/1997 | Meiron et al. |
| 5,609,269 | A | 3/1997 | Behnke et al. |
| 5,618,008 | A | 4/1997 | Dearwester et al. |
| 5,620,148 | A | 4/1997 | Mitchell |
| 5,624,025 | A | 4/1997 | Hixon |
| 5,630,526 | A | 5/1997 | Moody |
| 5,630,563 | A | 5/1997 | Meisner et al. |
| 5,631,317 | A | 5/1997 | Komatsu et al. |
| 5,642,810 | A | 7/1997 | Warner et al. |
| 5,649,676 | A | 7/1997 | Lord |
| D381,851 | S | 8/1997 | Sharpe |
| 5,653,403 | A | 8/1997 | Ritchey |
| 5,655,661 | A | 8/1997 | Rigby |
| 5,660,313 | A | 8/1997 | Newbold |
| 5,660,636 | A | 8/1997 | Shangold et al. |
| 5,667,092 | A | 9/1997 | Julius et al. |
| 5,669,576 | A | 9/1997 | Moody |
| 5,672,206 | A | 9/1997 | Gorman |
| D386,025 | S | 11/1997 | Mervar et al. |
| 5,687,875 | A | 11/1997 | Watts et al. |
| D387,590 | S | 12/1997 | Cameron et al. |
| 5,697,576 | A | 12/1997 | Bloch et al. |
| 5,697,577 | A | 12/1997 | Ogden |
| 5,704,565 | A | 1/1998 | Cheng |
| 5,704,566 | A | 1/1998 | Schutz et al. |
| 5,765,717 | A | 6/1998 | Gottselig |
| D397,265 | S | 8/1998 | Badillo |
| RE35,976 | E | 12/1998 | Gasparrini et al. |
| 5,848,762 | A | 12/1998 | Reinheimer et al. |
| 5,868,275 | A | 2/1999 | Moody |
| 5,868,335 | A | 2/1999 | Lebrun |
| 5,868,344 | A | 2/1999 | Melnick |
| 5,868,345 | A | 2/1999 | Beisser |
| 5,868,346 | A | 2/1999 | Cobos |
| 5,868,347 | A | 2/1999 | Paul et al. |
| 5,875,985 | A | 3/1999 | Cohen et al. |
| 5,887,759 | A | 3/1999 | Ayigbe |
| 5,887,818 | A | 3/1999 | Kelley |
| 5,893,531 | A | 4/1999 | Taylor et al. |
| 5,897,074 | A | 4/1999 | Marino |
| 5,901,921 | A | 5/1999 | Perlsweig |
| 5,904,316 | A | 5/1999 | Dunning et al. |
| 5,914,177 | A | 6/1999 | Smith, III et al. |
| 5,924,617 | A | 7/1999 | LaCount et al. |
| D412,439 | S | 8/1999 | Cormack |
| 5,938,013 | A | 8/1999 | Palumbo et al. |
| 5,950,960 | A | 9/1999 | Marino |
| 5,951,762 | A | 9/1999 | Shangold et al. |
| 5,958,187 | A | 9/1999 | Bhat et al. |
| 5,964,351 | A | 10/1999 | Zander |
| 5,967,452 | A | 10/1999 | Wilder |
| 5,971,138 | A | 10/1999 | Soughan |
| 5,971,142 | A | 10/1999 | Jones |
| D416,794 | S | 11/1999 | Cormack |
| D417,109 | S | 11/1999 | Johnson et al. |
| 5,979,821 | A | 11/1999 | LaCount et al. |
| 5,992,718 | A | 11/1999 | Zaranck |
| D417,987 | S | 12/1999 | Velazquez |
| 6,000,538 | A | 12/1999 | Lee |
| 6,000,658 | A | 12/1999 | McCall, Jr. |
| 6,007,019 | A | 12/1999 | Lynch |
| 6,010,001 | A | 1/2000 | Osborn, III |
| 6,015,125 | A | 1/2000 | Fischer |
| 6,024,216 | A | 2/2000 | Shillington et al. |
| 6,024,217 | A | 2/2000 | Ponsi et al. |
| 6,024,323 | A | 2/2000 | Palermo, Jr. |
| D421,691 | S | 3/2000 | Hoblitz |
| 6,036,134 | A | 3/2000 | Moody |
| D422,437 | S | 4/2000 | Conran et al. |
| 6,047,920 | A | 4/2000 | Dearwester et al. |
| 6,056,233 | A | 5/2000 | Von Schenk |
| 6,056,235 | A | 5/2000 | Brozinsky |
| 6,059,882 | A | 5/2000 | Steinhardt et al. |
| 6,059,928 | A | 5/2000 | Van Luu et al. |
| 6,068,118 | A | 5/2000 | Calloway |
| 6,070,821 | A | 6/2000 | Mitchell |
| 6,079,603 | A | 6/2000 | Smegal |
| 6,082,664 | A | 7/2000 | Phelps et al. |
| 6,085,899 | A | 7/2000 | Thorsbakken |
| 6,092,690 | A | 7/2000 | Bitowft et al. |
| 6,092,758 | A | 7/2000 | Gemmell |
| 6,092,759 | A | 7/2000 | Gemmell et al. |
| D429,282 | S | 8/2000 | Velazquez et al. |
| 6,098,836 | A | 8/2000 | Gottselig |
| 6,121,165 | A | 9/2000 | Mackey et al. |
| 6,138,939 | A | 10/2000 | Phelps et al. |
| 6,158,614 | A | 12/2000 | Haines et al. |

FOREIGN PATENT DOCUMENTS

| | | |
|---|---|---|
| GB | 990332 | 4/1965 |
| GB | 1324818 | 7/1973 |
| GB | 1 327 954 | 8/1973 |
| GB | 2 357 076 A | 6/2001 |
| WO | WO 93/17933 | 9/1993 |
| WO | WO 97/24054 | 7/1997 |
| WO | WO 00/00071 | 1/2000 |
| WO | WO 00/08998 | 2/2000 |

OTHER PUBLICATIONS

Search Report for Patent Cooperation Treaty application No. PCT/US 01/11686, Date of Mailing Jul. 11, 2001, 5 pages.
Search Report for Patent Cooperation Treaty application No. PCT/US 01/11131, Date of Mailing Jul. 23, 2001, 7 pages.
Search Report for Patent Cooperation Treaty application No. PCT/US 01/11447, Date of Mailing Jul. 19, 2001, 6 pages.

Search Report for Patent Cooperation Treaty application No. PCT/US 01/11467, Date of Mailing Jul. 19, 2001, 7 pages.
Search Report for Patent Cooperation Treaty application No. PCT/US 01/12091, Date of Mailing Jul. 9, 2001, 4 pages.
Search Report for Patent Cooperation Treaty application No. PCT/US 01/14118, Date of Mailing Jul. 19, 2001, 6 pages.
Search Report for Patent Cooperation Treaty application No. PCT/US 01/40677, Date of Mailing Jul. 19, 2001, 6 pages.
Letter, dated Apr. 4, 1998, and accompanying drawings.
Invitation to Pay Additional Fees for Patent Cooperation Treaty application No. PCT/US 01/27698, Date of Mailing Jan. 10, 2002, 7 pages.
Search Report for Patent Cooperation Treaty application No. PCT/US 01/28520, Date of Mailing Mar. 4, 2002, 7 pages.
Search Report for Patent Cooperation Treaty application No. PCT/US01/27698, Date of Mailing Apr. 5, 2002, 4 pages.

* cited by examiner

Fig. 11
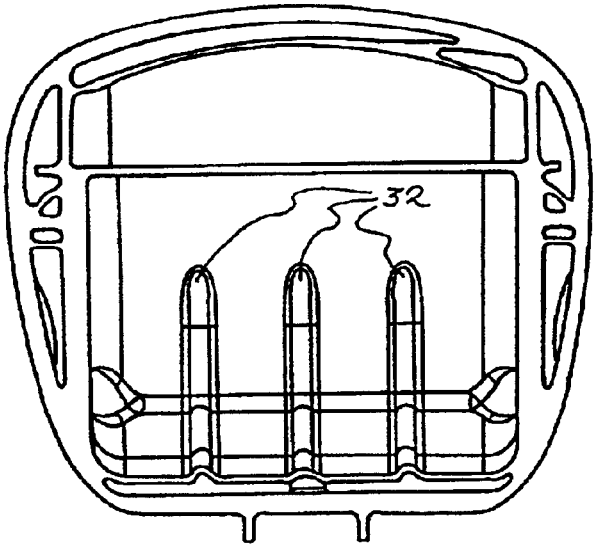
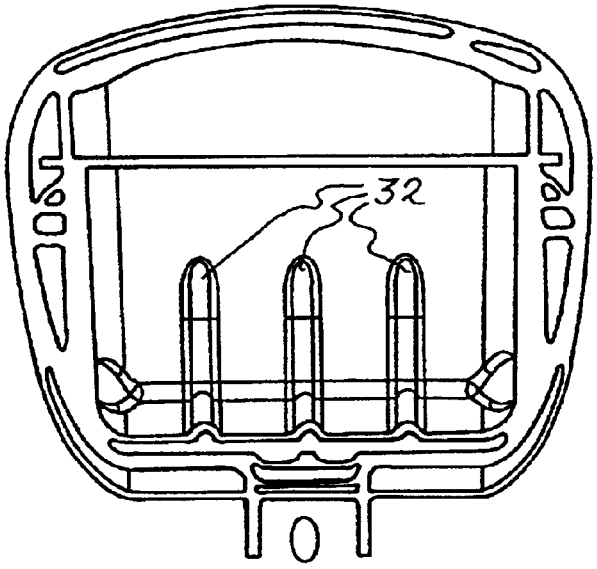
Fig. 12

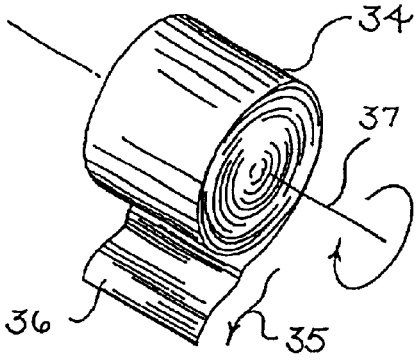
Fig. 18
Fig. 19
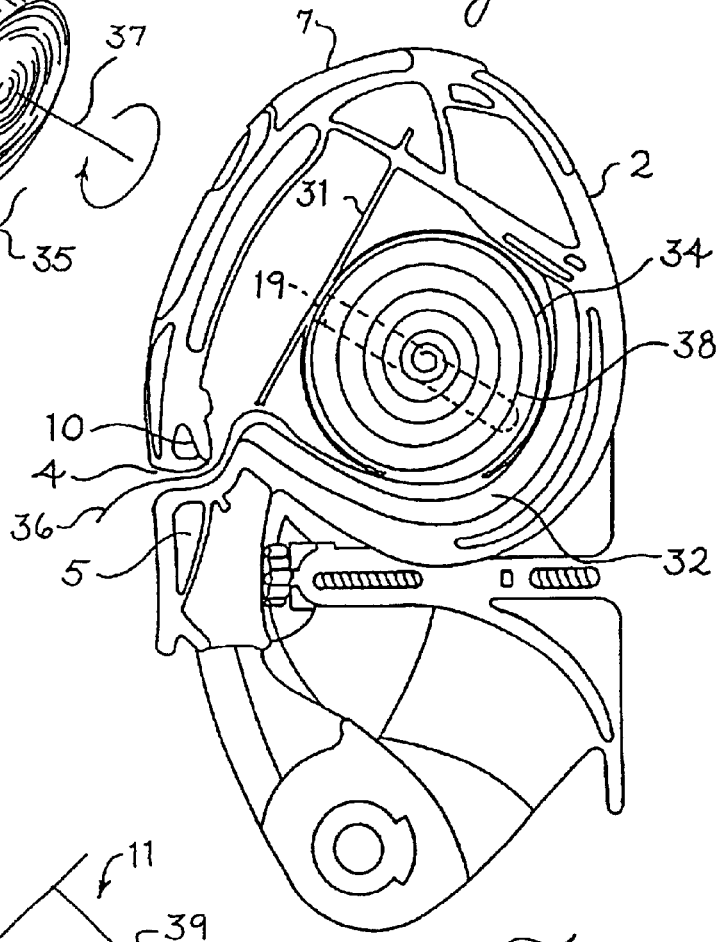
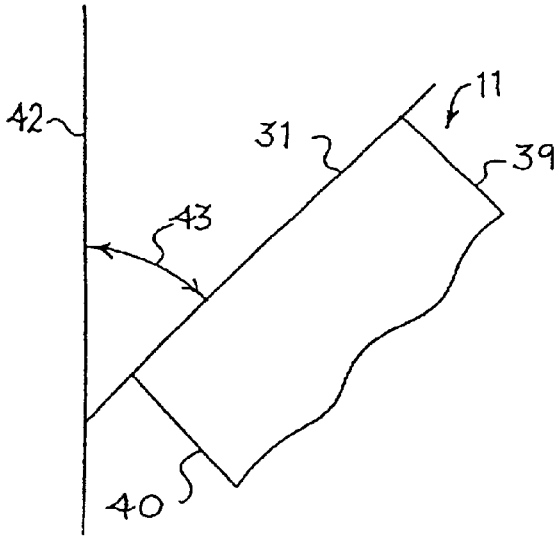
Fig. 21
Fig. 20
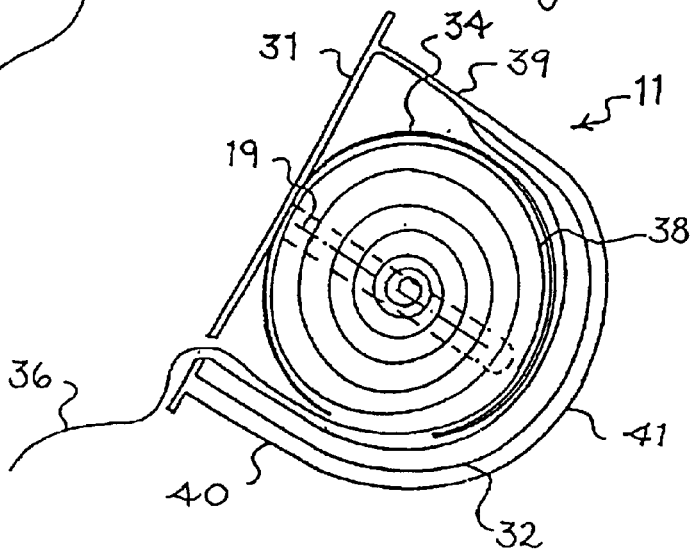

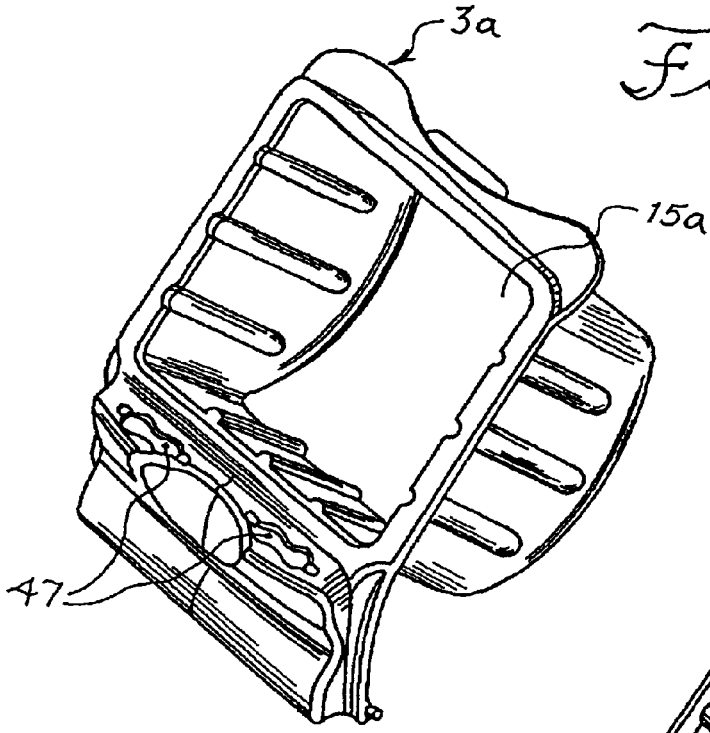
Fig. 26
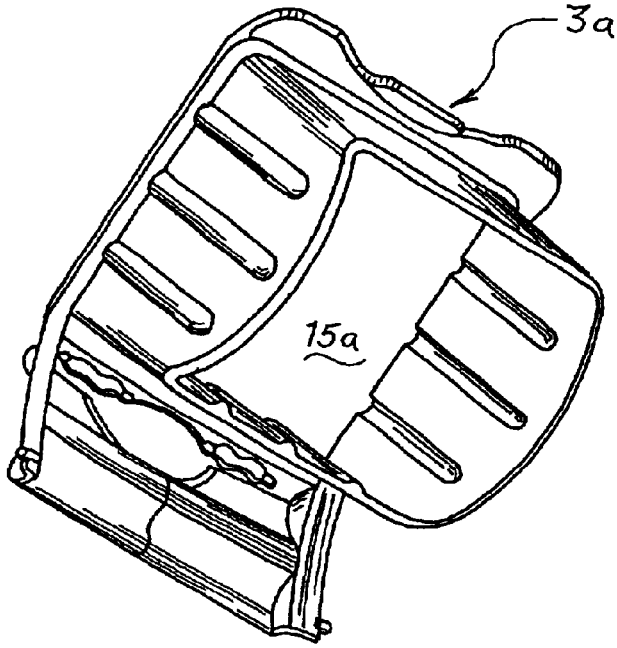
Fig. 27
Fig. 28
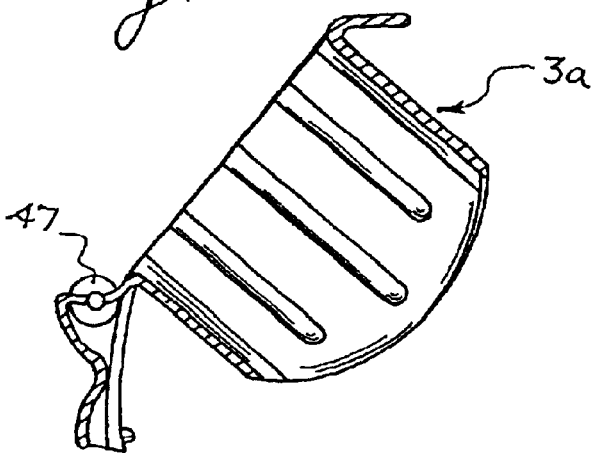

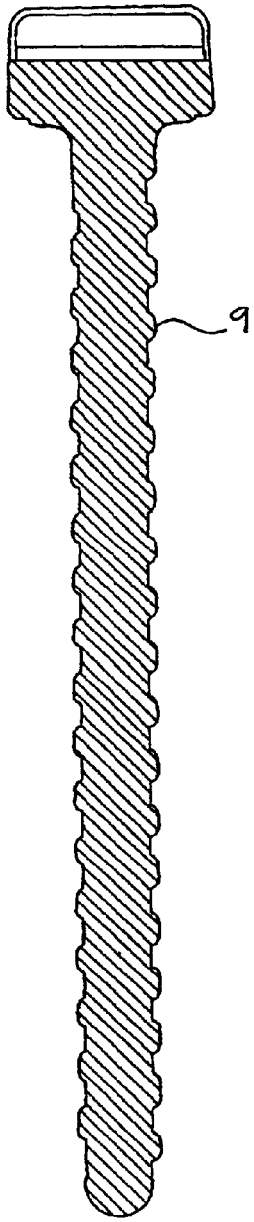
Fig. 46
Fig. 47
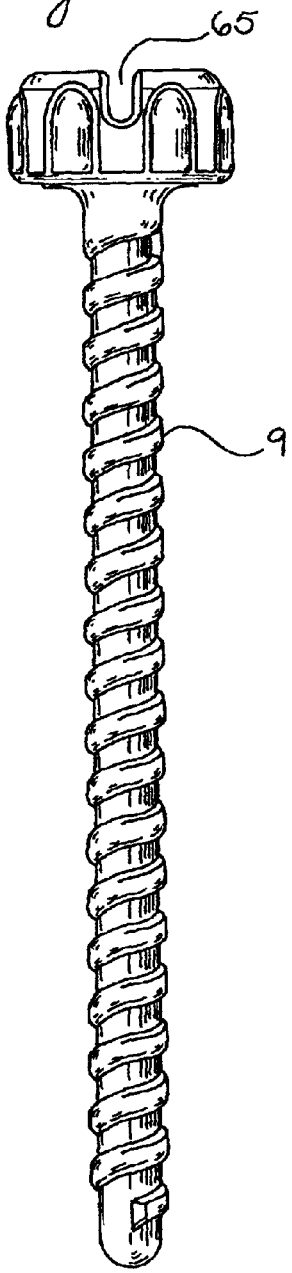
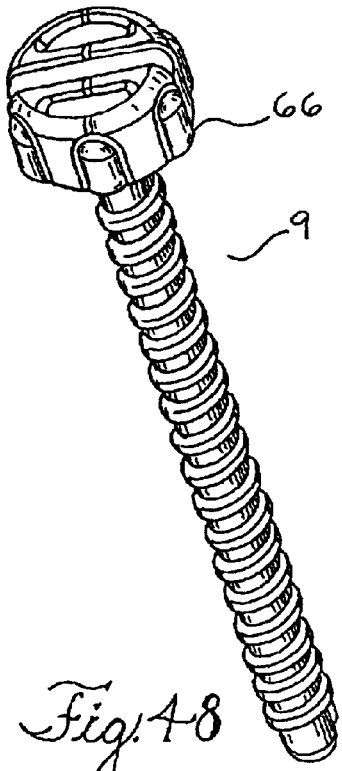
Fig. 48
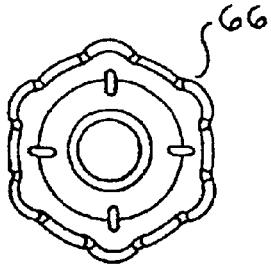
Fig. 49
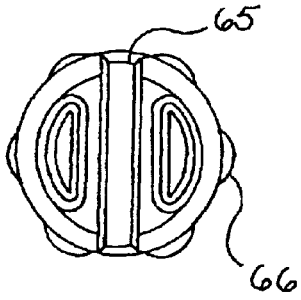
Fig. 50

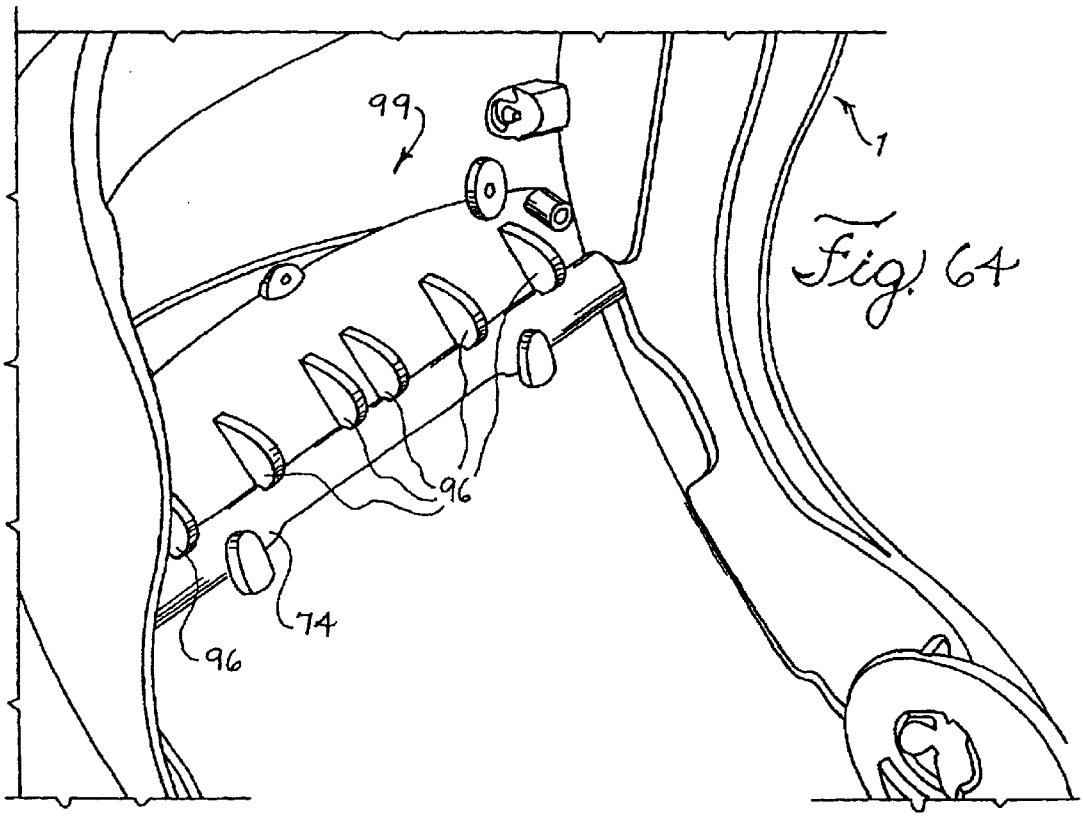
Fig. 64
Fig. 65
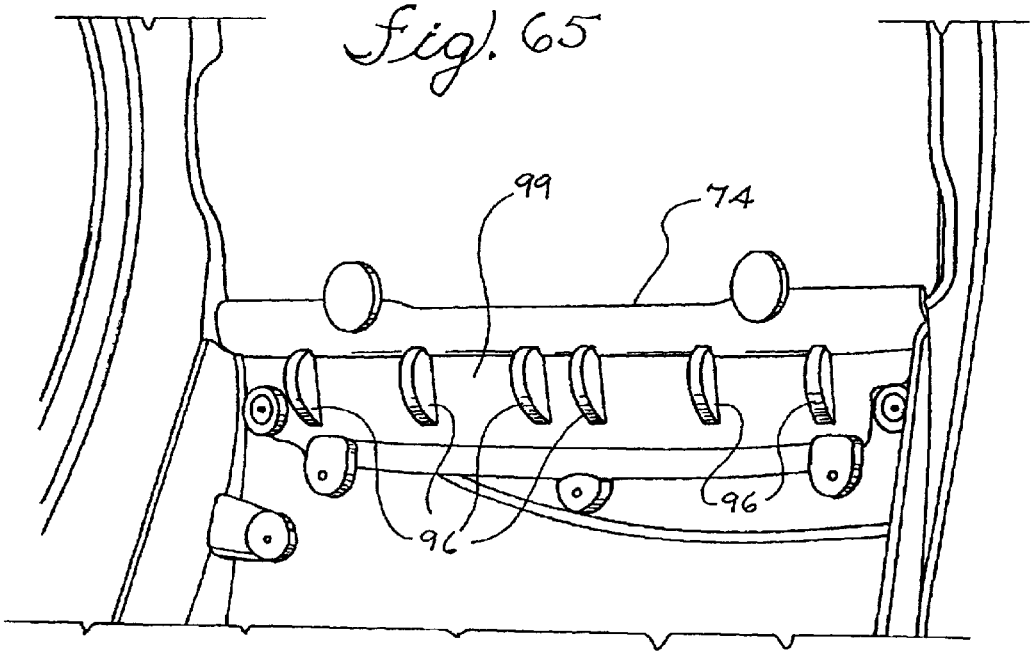

SYSTEM AND METHOD FOR REFILLING A DISPENSER

This application is a continuation of pending U.S. application entitled System and Method for Refilling a Dispenser, Ser. No. 09/660,049, filed Sep. 12, 2000, which is a continuation in part of pending U.S. application entitled System and Dispenser for Dispensing Wet Wipes, Ser. No. 09/565,227, filed May 4, 2000, which is a continuation in part of pending U.S. application entitled Dispenser For Premoistened Wipes, Ser. No. 09/545,995, which was filed on Apr. 10, 2000, the disclosures of which are hereby incorporated by reference. This application claims the benefit of Provisional Application No. 60/132,024 filed Apr. 30, 1999.

FIELD OF THE INVENTION

This invention relates to the use of wet or premoistened products alone or in conjunction with other products or systems to dispense such products.

BACKGROUND OF THE INVENTION

Wet products such as wet wipes have many applications. They may be used with small children and infants when changing diapers, they may be used for household cleaning tasks, they may be used for cleaning hands, they may be used as a bath tissue, they may be used as by a caregiver to clean a disabled or incontinent adult, or they may be used in and for a whole host of other applications, where it is advantages to have a wipe or towel that has some wetness or moisture in it.

Wet wipes have been traditionally dispensed in sheet form from a tub like container with a hinged lid on the top. The lid is opened and individual or singularized sheets of the wipes are removed. Another type of container that has been used for wet wipes provides a roll of wipes in which the wipes are pulled from the top of the container in a direction that is parallel to the axis of the roll. These wipes are pulled from the center of a hollow coreless roll that has perforated sheets. These containers generally have a snap top lid that is opened to expose a piece of the wipes that can then be pulled to remove the desired amount of wipes. Once pulled out the wipes can then be tom off, usually at a perforation, and the lid closed.

Wet wipes can be any wipe, towel, tissue or sheet like product including natural fibers, synthetic fibers, synthetic material and combinations thereof, that is wet or moist or becomes wet during use or prior to use. Wet wipes may be dispersible when in contact with water or may be non-dispersible. Examples of wet wipes are disclosed in application Ser. Nos. 09/564,449; 09/564,213; 091565,125; 09/564,837; 09/564,939; 09/564,531; 09/564,268; 09/564,424; 09/564,780; 09/564,212; 09/565,623 all filed May 4, 2000, and application Ser. No. 09/223,999 entitled Ion-Sensitive Hard Water Dispersible Polymers And Applications Therefore, filed Dec. 31, 1998 the disclosures of which are incorporated herein by reference. Embodiments of dispensers are described in application Ser. No. 09/659,307 filed Sep. 12, 2000, having the disclosure of which is incorporated herein by reference.

SUMMARY OF THE INVENTION

In an embodiment of the present invention there is provided a method for providing refills for a wet wipes dispenser comprising: obtaining a cartridge for a wet wipes dispenser; determining the dimensions of the cartridge; determining that the cartridge is asymmetrical; determining that the cartridge has two protrusions on one side and one protrusion on the other; determining the dimensions of the protrusions; determining the relative locations of the protrusions with respect to the dimensions of the cartridge; manufacturing a cartridge having substantially the same dimensions, protrusions, and placement of protrusions as the obtained cartridge; placing wet wipes in the manufactured cartridge; and, providing a bacterial resistant seal to the manufactured cartridge containing the wet wipes.

These embodiments may further comprise the method in which the two protrusions are space about 28.2 mm apart, and/or in which the one protrusion is centered with respect to the two protrusions.

In an embodiment of the present invention there is provided a method of providing a wet wipes refill for use with a dispenser comprising; manufacturing a container having four sides, and a bottom; the container being asymmetric; providing the container with a lip located along the top of the four sides; placing a roll of wet wipes in the container; sealing the container; and, providing instructions for the placement of the container in a wet wipes dispenser.

In an embodiment of the present invention there is provided a method for providing refills for a wet wipes dispenser comprising: determining the measurements of a Kimberly-Clark wet wipes cartridge; manufacturing a cartridge having similar dimensions; providing a roll of wet wipes in the cartridge; and, providing instruction to place the cartridge in a dispenser.

In an embodiment of the present invention there is provided a method for providing refills for a wet wipes dispenser comprising: determining the measurements of a coreless roll of wet wipes; manufacturing a roll of wet wipes having similar dimensions; sealing the roll of wet wipes in a bacteria resistant package; and, providing instruction to place the roll in a dispenser.

These methods may further comprise the method wherein the manufactured roll is coreless, wherein the manufactured roll is hollow, and/or wherein the manufactured roll is cored.

In an embodiment of the present invention there is provided a method for providing refills for a wet wipes dispenser comprising: determining the measurements of a wet wipes cartridge; manufacturing a cartridge based on the measurements; providing a roll of wet wipes in the cartridge; and, providing instruction to place the cartridge in a dispenser.

In an embodiment of the present invention there is provided a method for providing refills for a wet wipes dispenser comprising: determining the measurements of a wet wipes cartridge; using the measurements to make a cartridge; providing a roll of wet wipes in the cartridge; and, providing instruction to place the cartridge in a dispenser.

In an embodiment of the present invention there is provided a method for providing refills for a wet wipes dispenser comprising: determining the dimensions of a wet wipes cartridge; manufacturing a cartridge based on the dimensions; providing a roll of wet wipes in the cartridge; and, providing instruction to place the cartridge in a dispenser.

In an embodiment of the present invention there is provided a method of providing wet wipes for use in a wet wipes dispenser comprising: obtaining wet wipes; obtaining a cartridge; the cartridge being asymmetrical to enable the cartridge to be placed in a dispenser in only one orientation; closing the cartridge; and, providing instruction to place the cartridge in a dispenser.

In an embodiment of the present invention there is provided a method of providing wet wipes for use in a wet wipes dispenser comprising: obtaining a roll of wet wipes; placing the roll of wet wipes in a package; sealing the package; and, providing instructions for removing the wet wipes from the package and for placing the wet wipes in a cartridge in a dispenser.

In an embodiment of the present invention there is provided a method of providing wet wipes refills for use with a dispenser comprising; manufacturing a container having four sides, and a bottom; the container being asymmetric; placing a roll of wet wipes in the container; sealing the container; and, providing instructions for the placement of the container in a wet wipes dispenser.

In an embodiment of the present invention there is provided a method of providing wet wipes refills for use with a dispenser comprising; manufacturing a container having four sides, and a bottom; providing the container with a lip located along the top of the four sides; placing a roll of wet wipes in the container; sealing the container; and, providing instructions for the placement of the container in a wet wipes dispenser.

In an embodiment of the present invention there is provided a method for providing refills for a wet wipes dispenser comprising: obtaining a cartridge for a wet wipes dispenser; determining the dimensions of the obtained cartridge; manufacturing a cartridge having substantially the same dimensions as the obtained cartridge; placing a coreless roll of wet wipes in the manufactured cartridge; and, providing a bacterial resistant seal to the manufactured cartridge containing the wet wipes.

In an embodiment of the present invention there is provided a method of providing wet wipes refills for use with a dispenser comprising; manufacturing a container having four sides, and a bottom; providing the container with a lip located along the top of the four sides; placing a roll of wet wipes in the container; sealing the container; and, providing instructions for the placement of the container in a wet wipes dispenser.

In an embodiment of the present invention there is provided a method for providing refills for a wet wipes dispenser comprising: obtaining a cartridge for a wet wipes dispenser; determining the dimensions of the cartridge; determining that the cartridge is asymmetrical; determining that the cartridge has two protrusions on one side and one protrusion on the other; determining the dimensions of the protrusions; determining the relative locations of the protrusions with respect to the dimensions of the a cartridge; manufacturing a cartridge having substantially the same dimensions, protrusions and placement of protrusions as the obtained cartridge; the manufactured cartridge having a length that is no greater than 135 mm; placing wet wipes in the manufactured cartridge; and, providing a bacterial resistant seal to the cartridge containing the wet wipes.

In an embodiment of the present invention there is provided a method of providing wet wipes refills for use with a dispenser comprising; manufacturing a container having four sides, and a bottom; providing the container with a lip located along the top of the four sides; placing a roll of wet wipes in the container; the roll of wet wipes having a length that is no greater than 135 mm; sealing the container; and, providing instructions for the placement of the container in a wet wipes dispenser.

In an embodiment of the present invention there is provided a method of providing wet wipes refills for use with a dispenser comprising; manufacturing a container having four sides, and a bottom; the length of the container being no greater than 135 mm; placing a roll of wet wipes in the container; sealing the container; and, providing instructions for the placement of the container in a wet wipes dispenser.

In an embodiment of the present invention there is provided a method of refilling a wet wipes dispenser comprising: a) obtaining a plurality of cartridges, each cartridge in the plurality containing a roll of wet wipes; b) removing a cartridge from the plurality; c) opening the cartridge to expose the roll of wet wipes; d) opening the cover of the wet wipes dispenser; e) placing the cartridge in the open wet wipes dispenser; f) unrolling a portion of the roll of wet wipes to create a tail; g) closing the cover so that at least a portion of the tail is located outside the dispenser; and, f) repeating steps b) thorough g) when the roll of wet wipes in the cartridge is finished.

These embodiments may further comprise the method wherein the plurality of cartridges contains four cartridges and steps b) through g) are repeated at least three times and/or wherein the plurality of cartridges contains four cartridges in an integral pack.

In an embodiment of the present invention there is provided a method for providing refills for a wet wipes dispenser comprising: obtaining a dispenser for wet wipes, the obtained dispenser having a housing, a cover, and a tray, the cover having a wiper blade and a gasket; determining the measurements of a dispenser; making a cartridge to fit into the dispenser based on the determined measurements; and, providing a roll of wet wipes in the manufactured cartridge.

In an embodiment of the present invention there is provided a method for providing refills for a wet wipes dispenser comprising: obtaining a dispenser for wet wipes, the obtained dispenser having a housing, a cover, and a tray, the cover having a wiper blade and a gasket; determining the measurements of a dispenser; obtaining a cartridge for wet wipes; determining the measurements of the obtained cartridge; using the obtained measurements to make a cartridge; and, providing a roll of wet wipes in the made cartridge.

In an embodiment of the present invention there is provided a method for providing refills for a wet wipes dispenser comprising: obtaining a wet wipes dispenser, the obtained dispenser having a at least four side walls, a tray and a cover; determining the dimensions of the obtained dispenser; using the obtained dimensions to establish the size of a roll of wet wipes for use in the dispenser; and, manufacturing a roll of wet wipes having the established size.

DRAWINGS

Figure 2A:
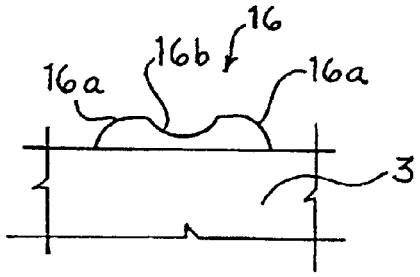
FIG. 2 is an exploded view of a dispenser and cartridge.

FIG. 2*a* is a plan view of a portion of the front of the tray.

Figure 3:
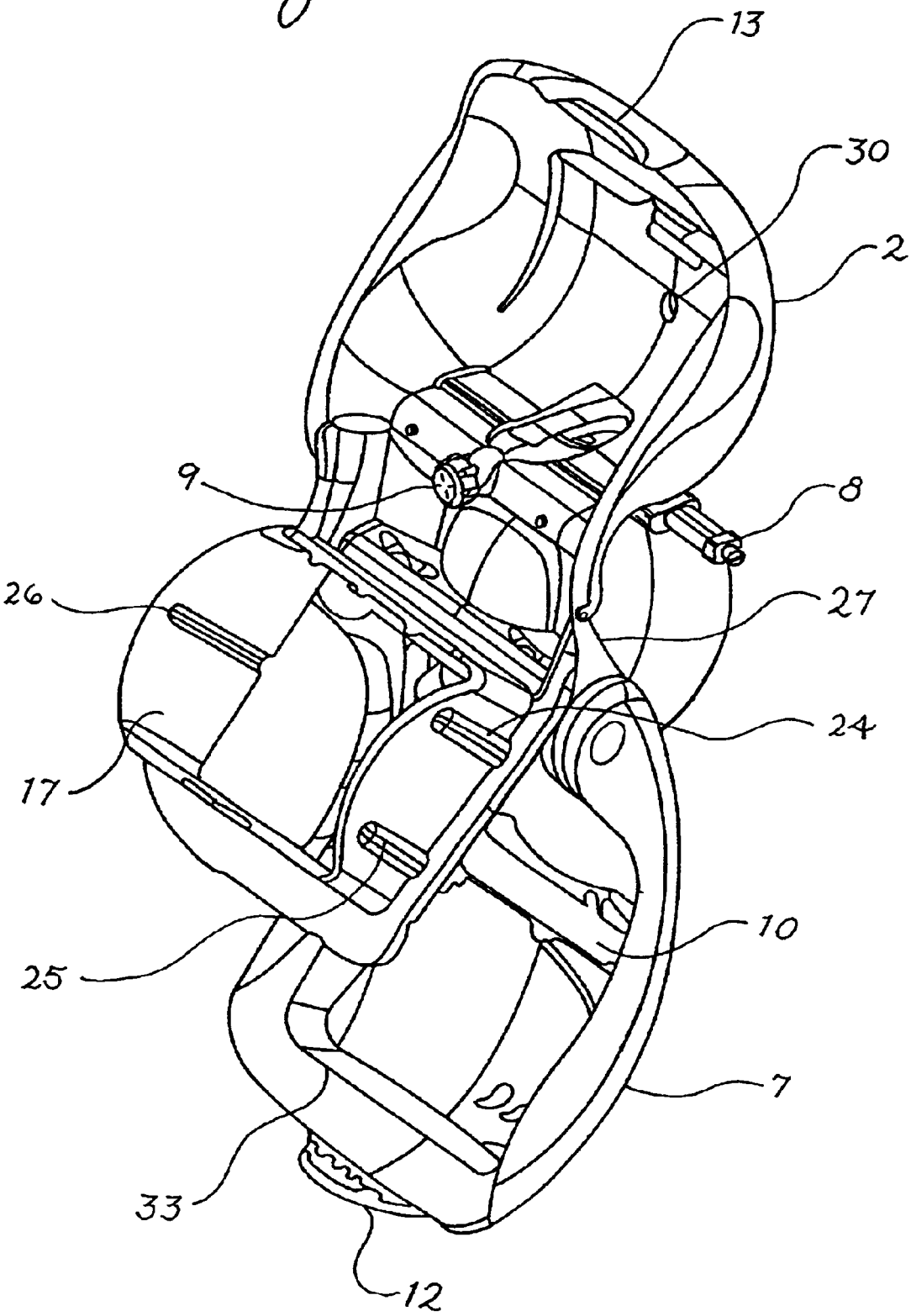

FIG. 3 is a perspective view of an open dispenser.

Figure 4:
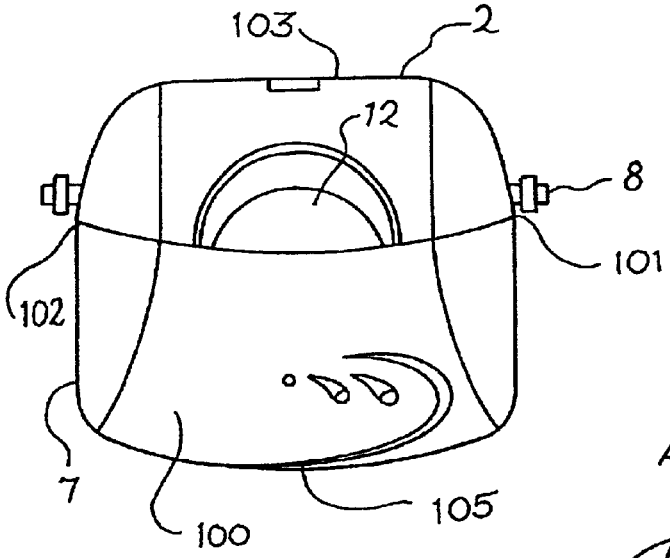

FIG. 4 is a top view of a dispenser.

Figure 5:
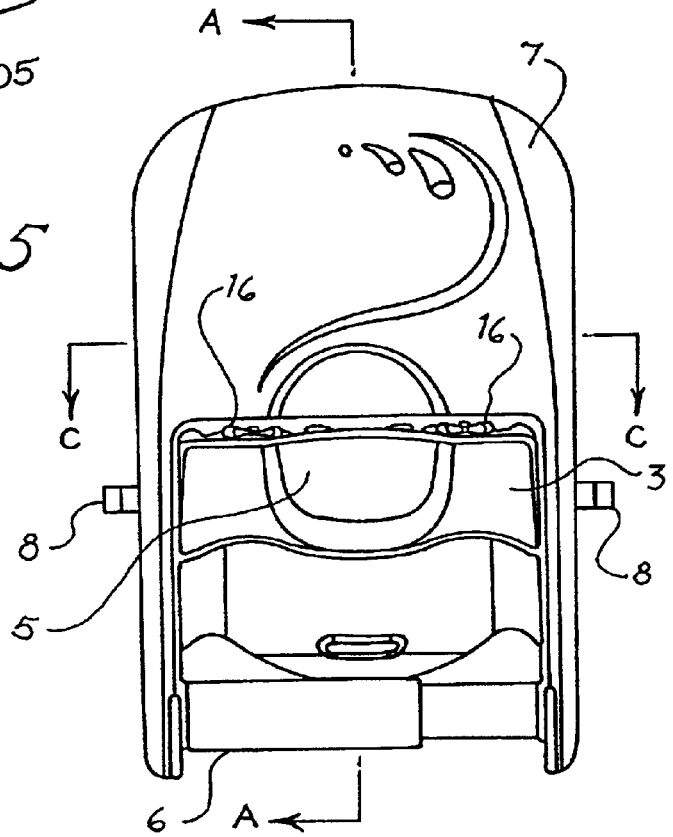

FIG. 5 is a front view of a dispenser.

Figure 6:
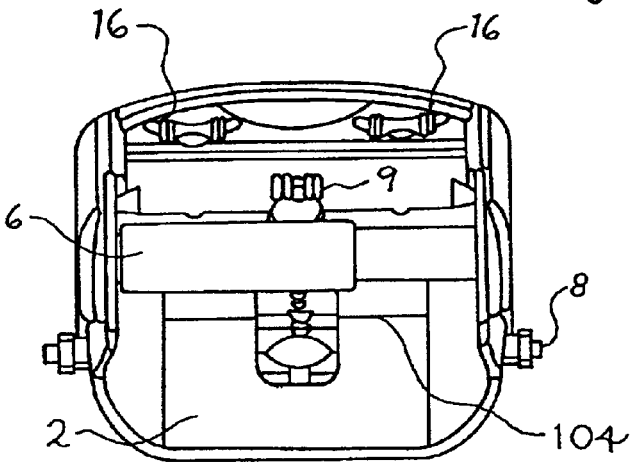

FIG. 6 is a bottom view of a dispenser.

Figure 7:
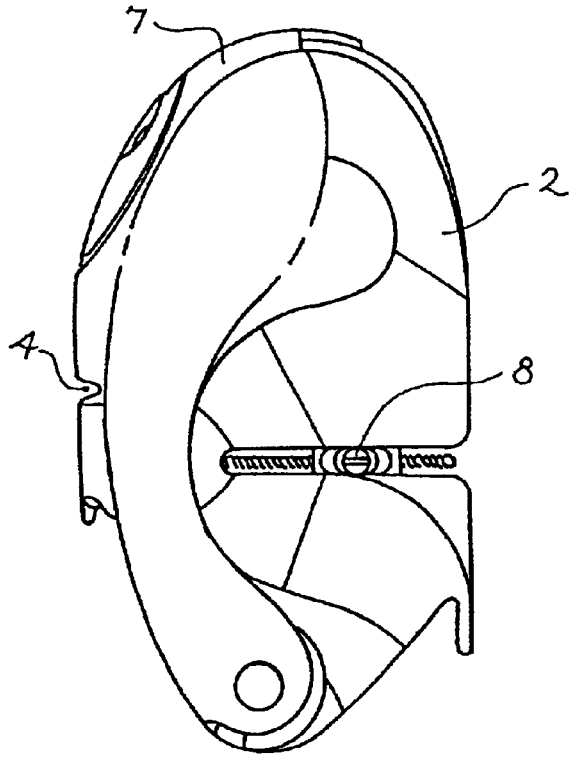

FIG. 7 is a side view of a dispenser.

Figure 8:
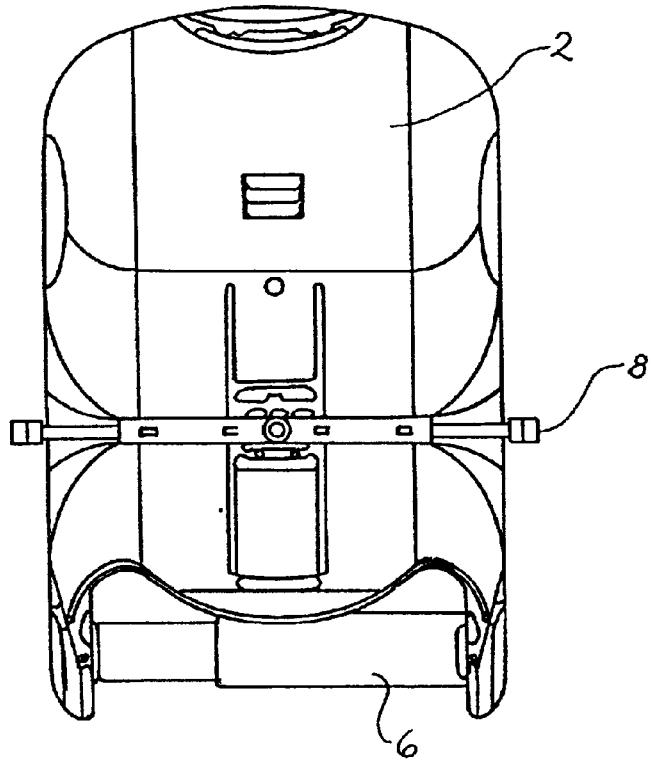

FIG. 8 is a back view of a dispenser.

Figure 9:
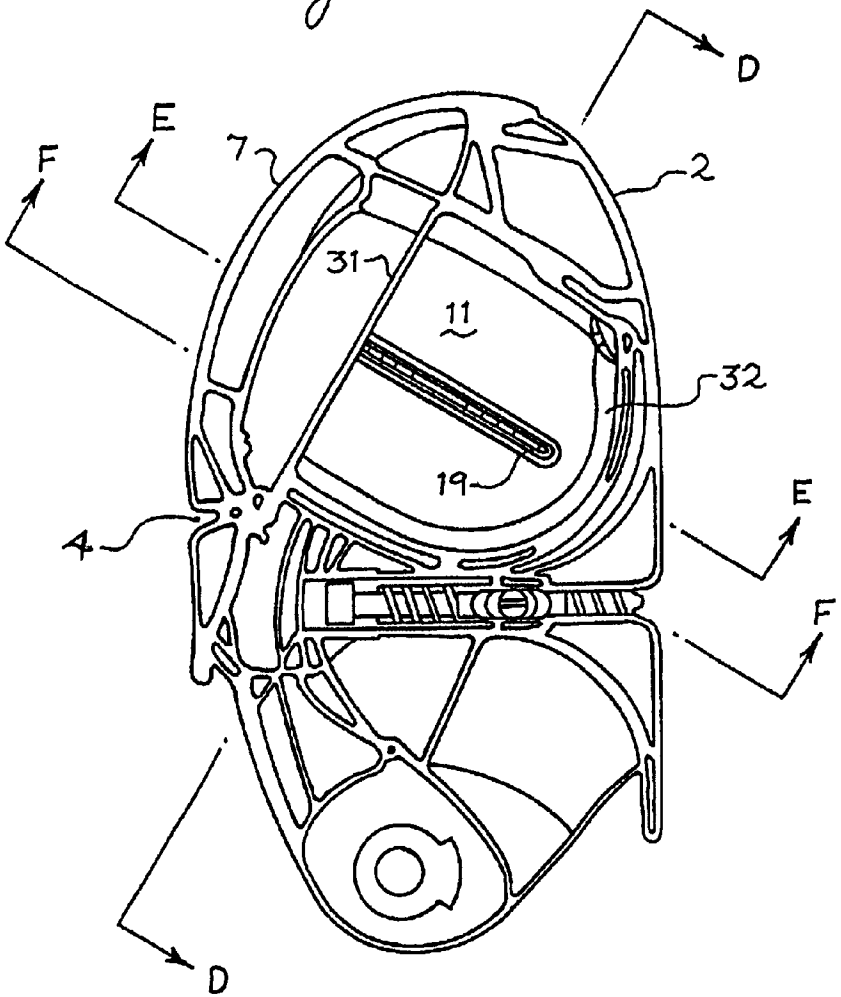

FIG. 9 is a cross section view of a dispenser and cartridge taken along line A—A of FIG. 5.

Figure 10:
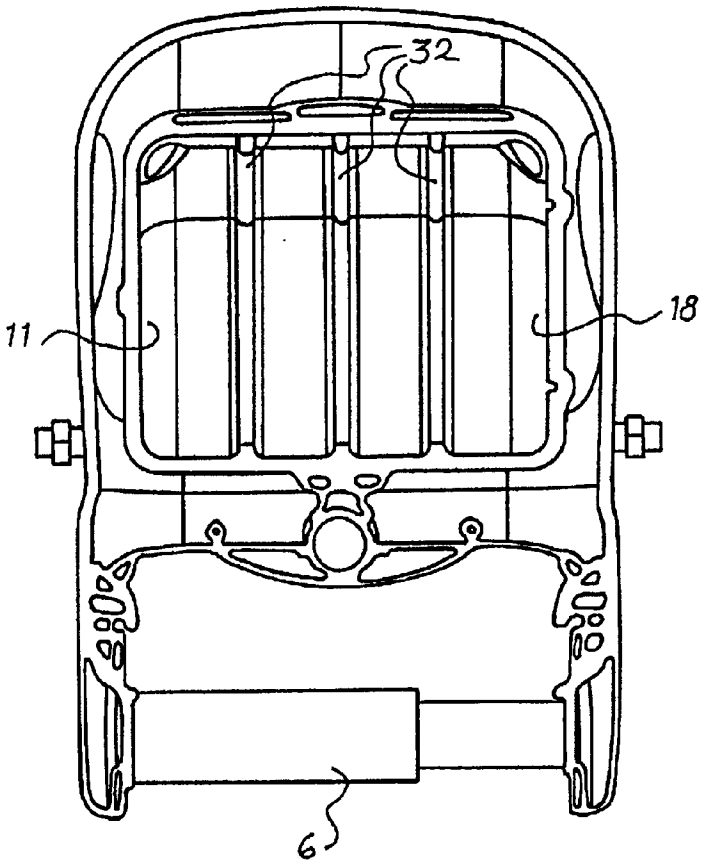

FIG. 10 is a cross section view along line D—D of FIG. 9.

FIG. 11 is a cross section view along line E—E of FIG. 9.

FIG. 12 is a cross section view along line F—F of FIG. 9.

Figure 13:
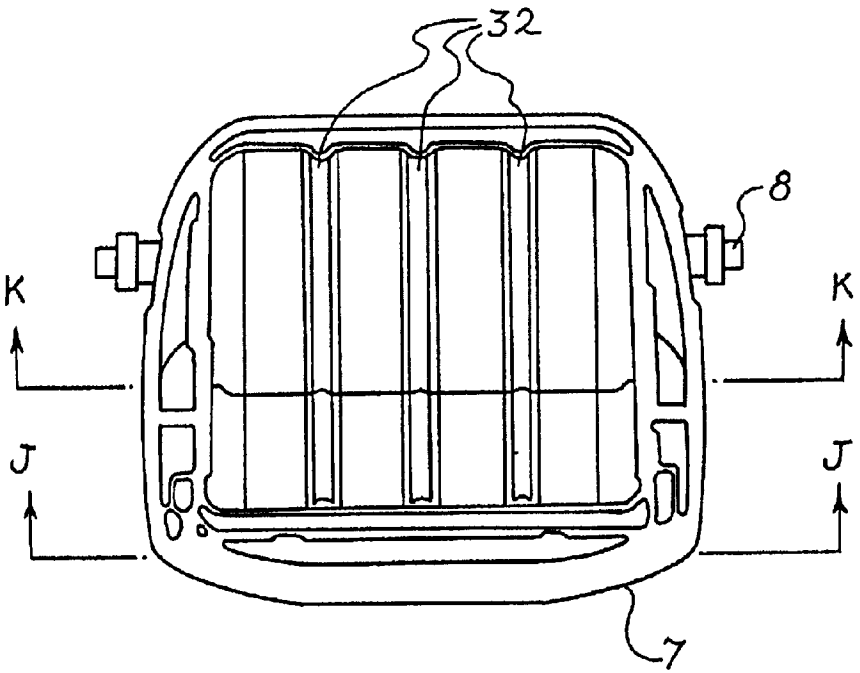

FIG. 13 is a cross section view of a dispenser and cartridge taken along line C—C of FIG. 5.

Figure 14:
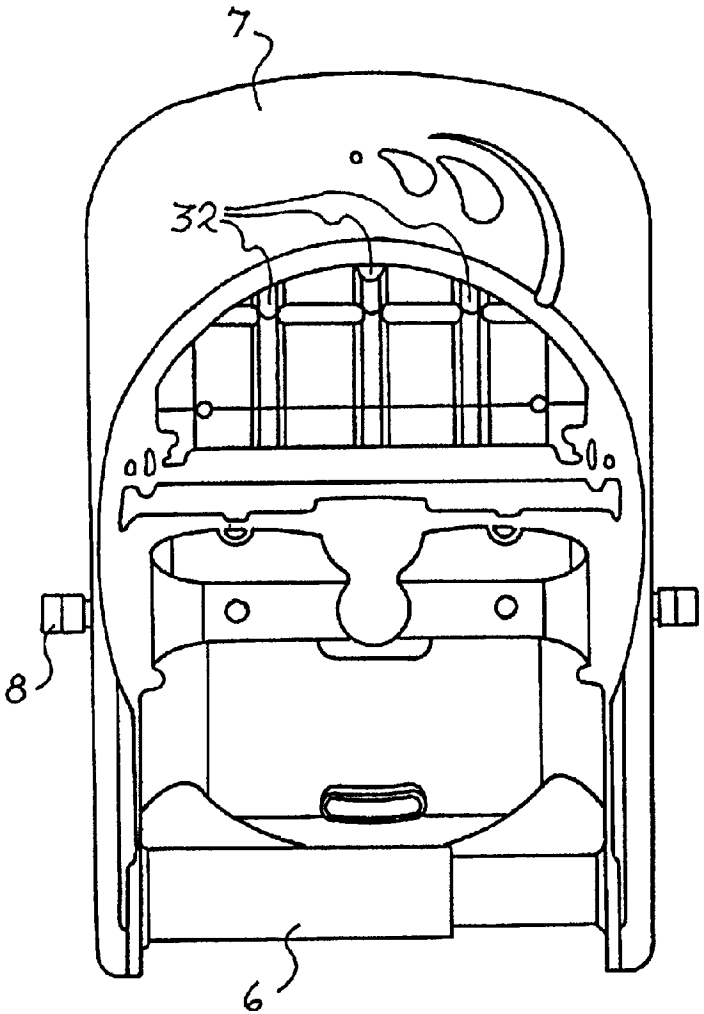

FIG. 14 is a cross section view along line J—J of FIG. 13.

Figure 15:
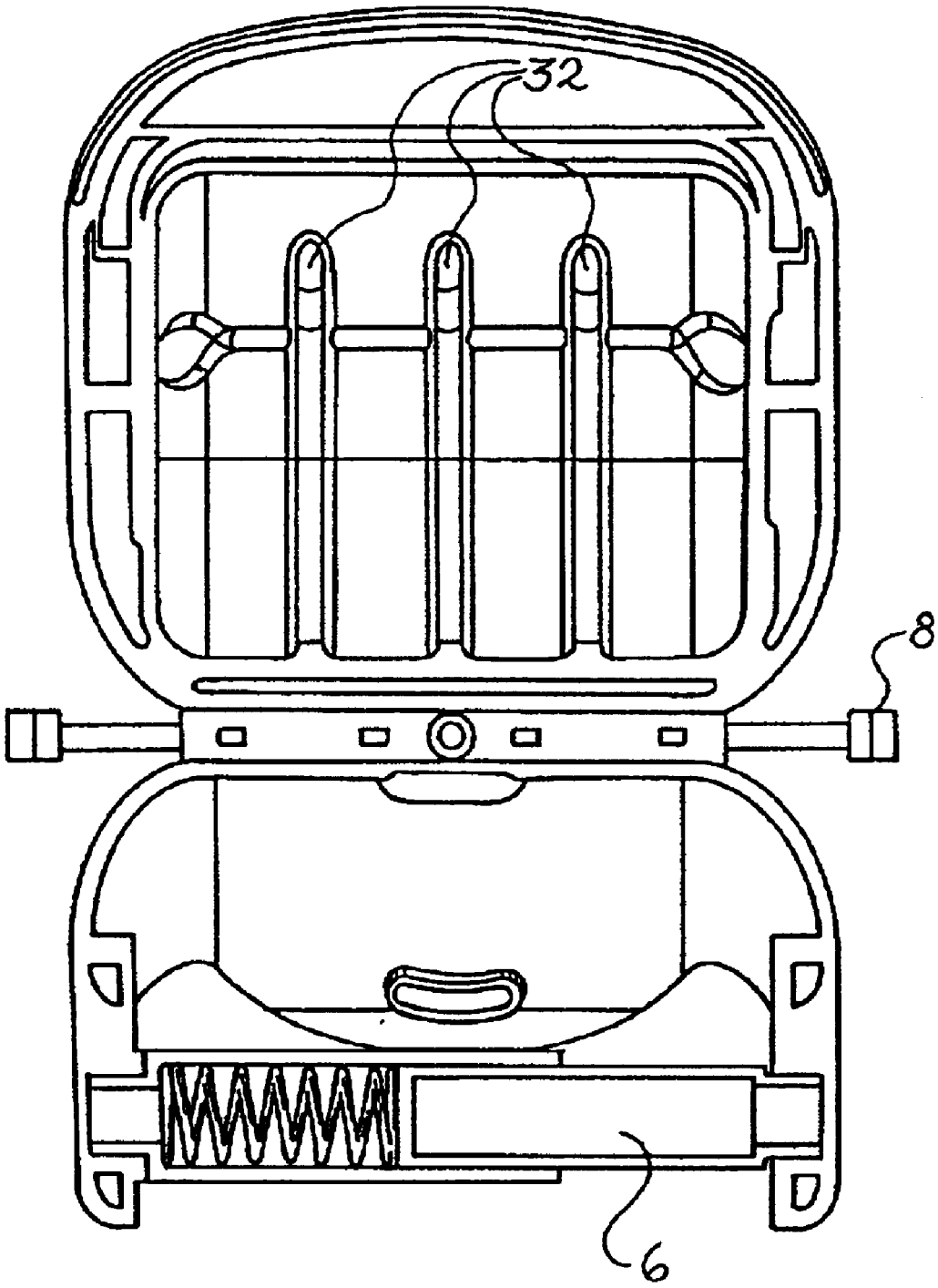

FIG. 15 is a cross section view along line K—K of FIG. 13.

Figure 16:
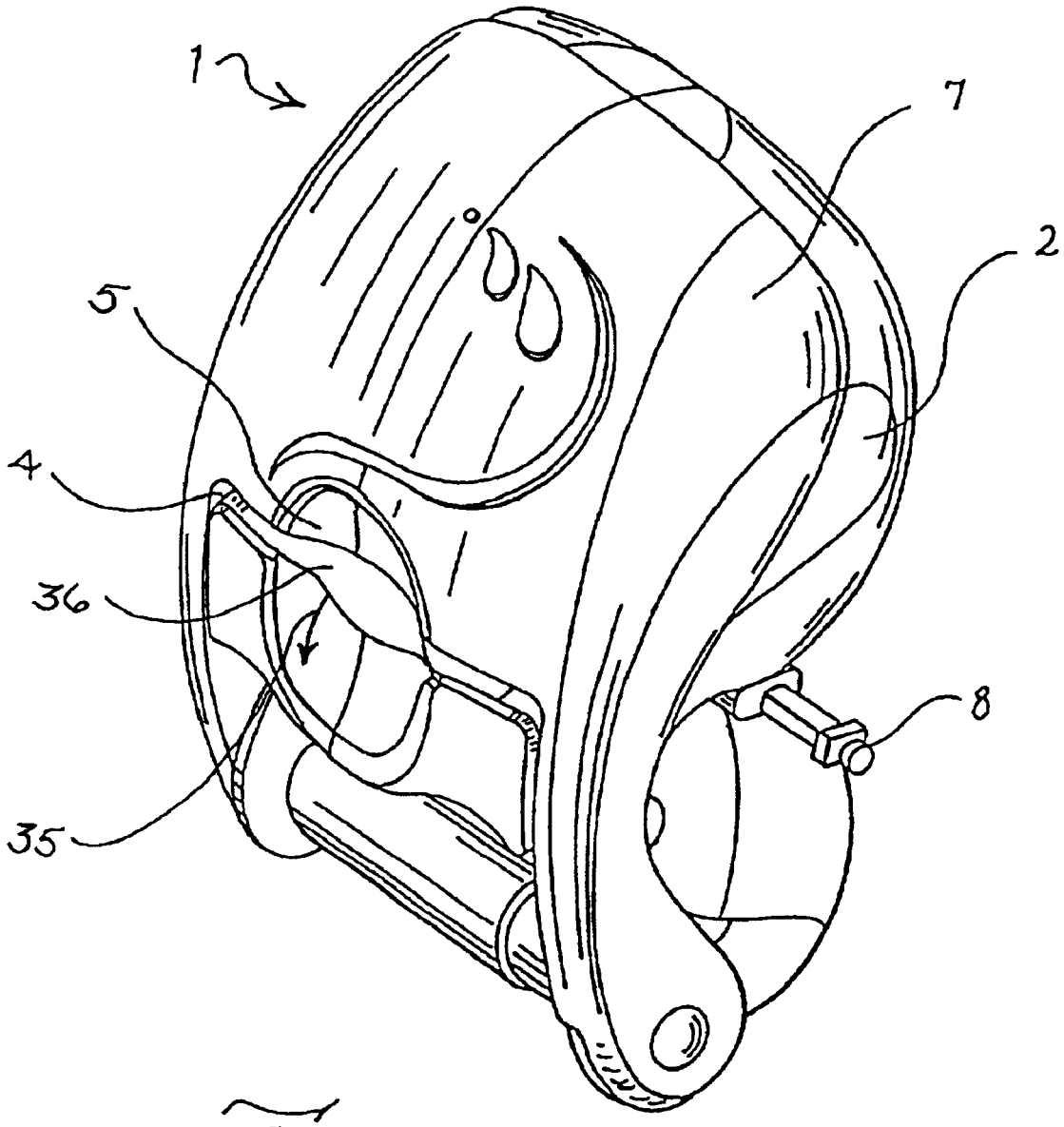

FIG. 16 is a perspective view of a dispenser with a wet wipe.

Figure 17:
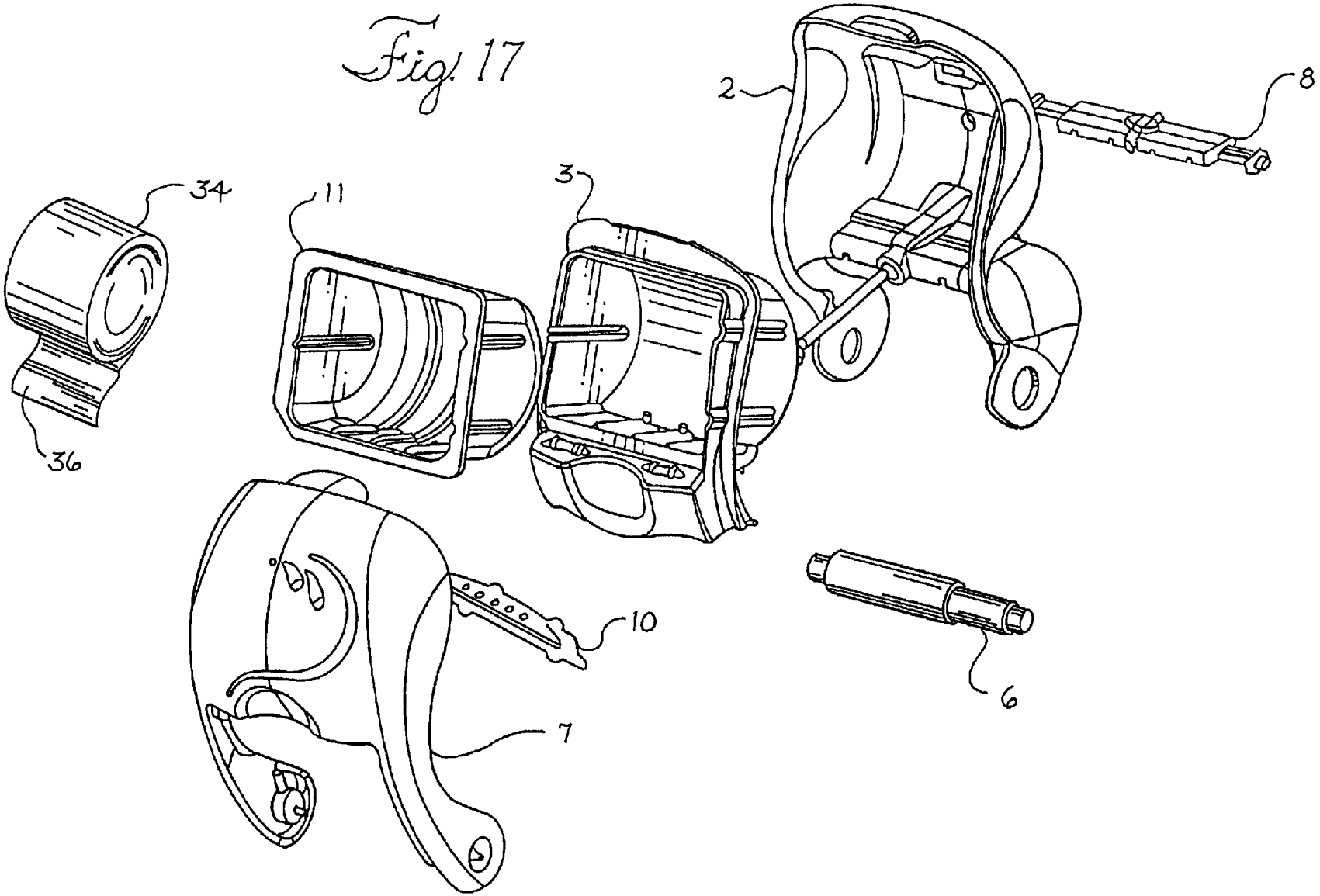

FIG. 17 is a perspective view of a dispenser, a cartridge and a roll of wet wipes.

FIG. 18 is a perspective view of a roll of wet wipes

FIG. 19 is a cross section view of a dispenser, a cartridge and a roll of wet wipes.

FIG. 20 is a cross section view of a cartridge and a roll of premoistened wipes.

FIG. 21 is a cross section view of a cartridge.

Figure 22:
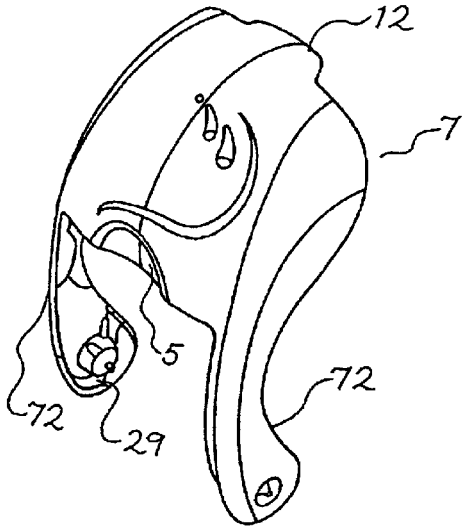

FIG. 22 is a perspective view of the outside of a cover.

Figure 23:
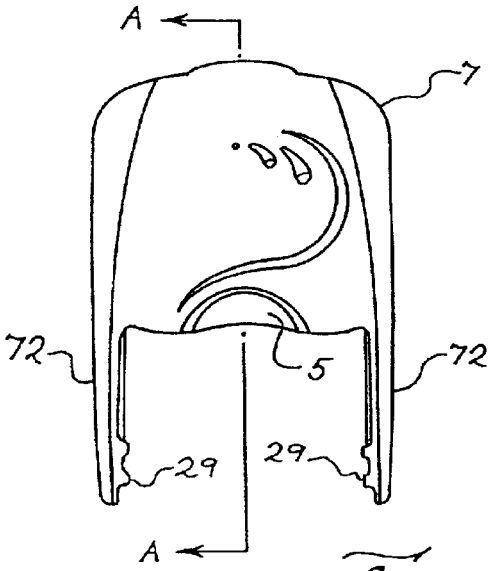

FIG. 23 is a front view of the outside of a cover.

Figure 24:
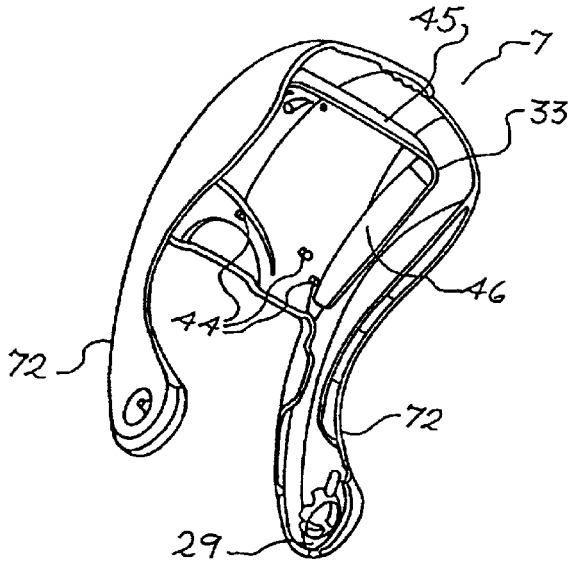

FIG. 24 is a perspective view of the inside of a cover.

Figure 25:
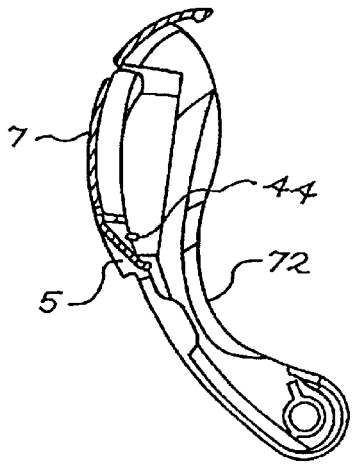

FIG. 25 is a cross section view of a cover.

FIGS. 26–28 are views of a tray.

Figure 29:
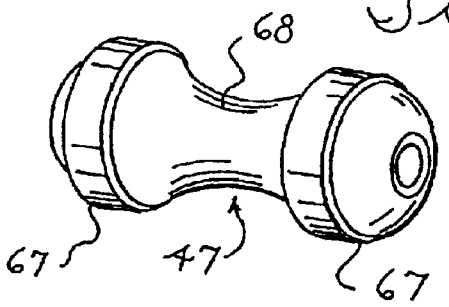
Figure 30:
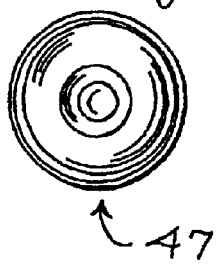
Figure 31:
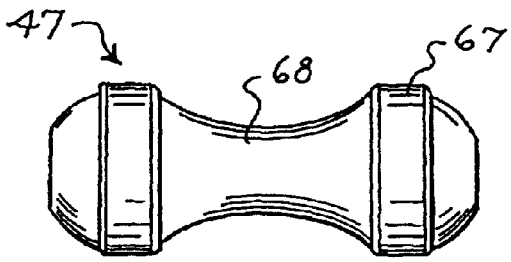

FIGS. 29–31 are views of a roller.

FIGS. 32–37 are views of a wiper assembly.

Figure 35:
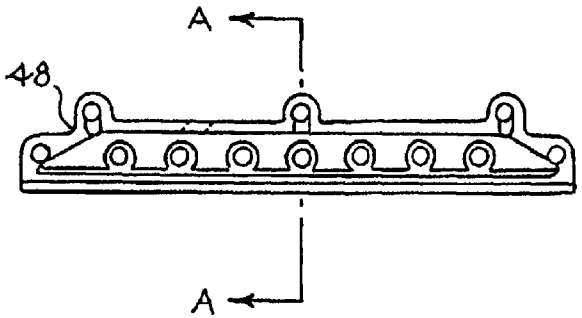
Figure 36:
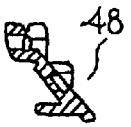

FIG. 36 is a view along line A—A of FIG. 35.

Figure 32:
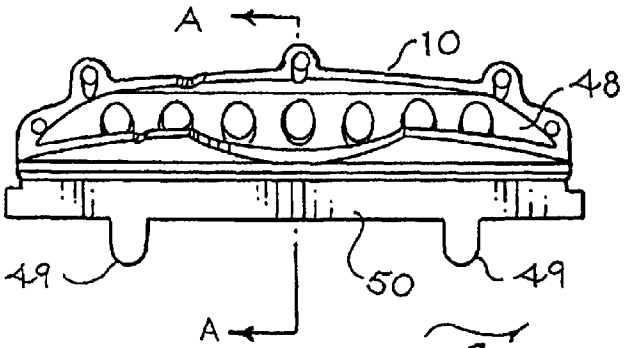
Figure 34:
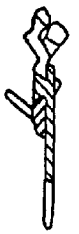

FIG. 34 is a view along line A—A of FIG. 32.

Figure 38:
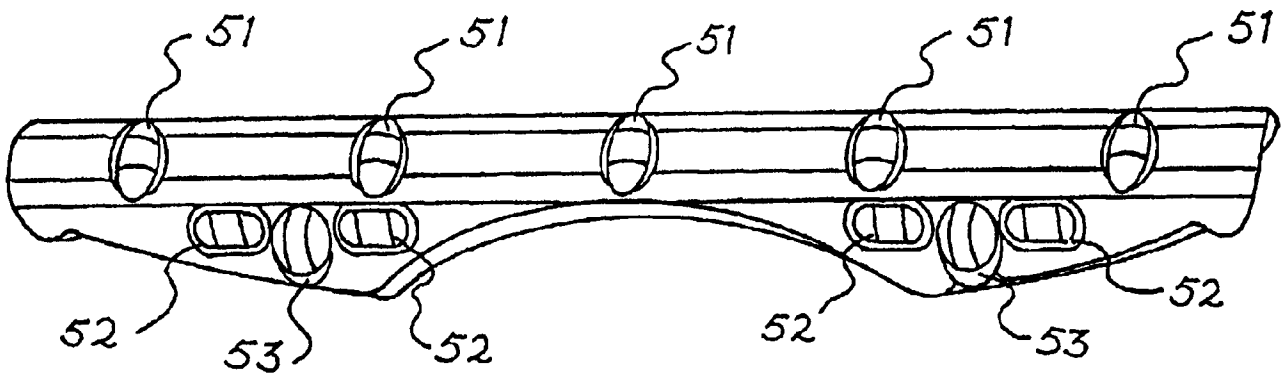
Figure 39:
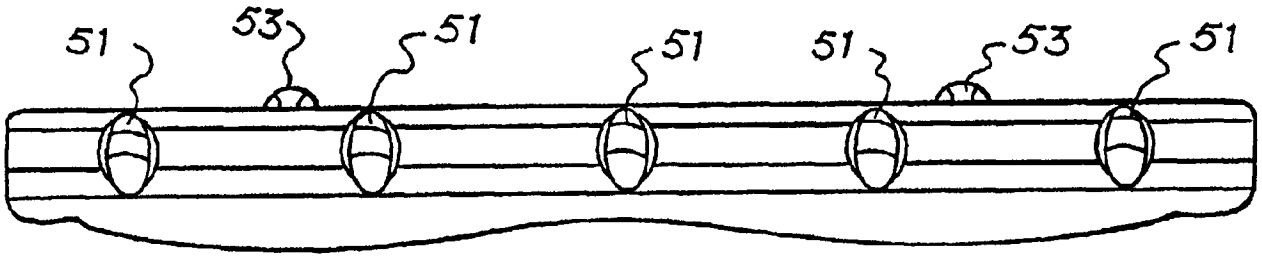
Figure 42:
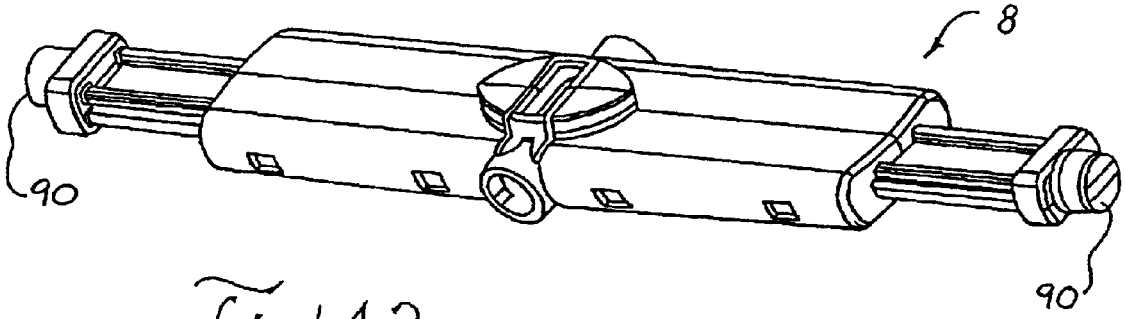

FIGS. 38–39 are views of a wiper.

Figure 40:
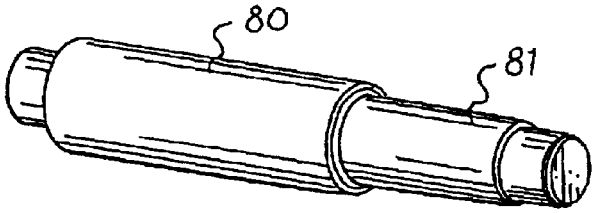
Figure 41:
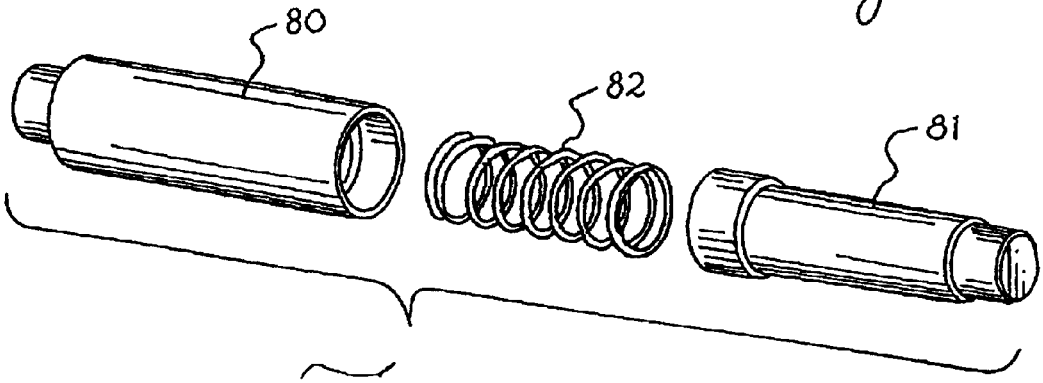
Figure 33:
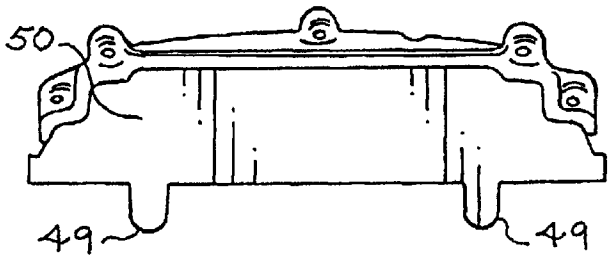
Figure 37:
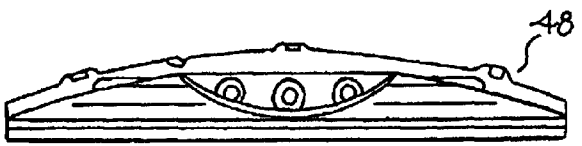

FIGS. 40–41 are views of a roller.

FIGS. 42–45 are views of a mounting assembly.

FIGS. 46–50 are views of a screw used in conjunction with the mounting assembly.

Figure 51:
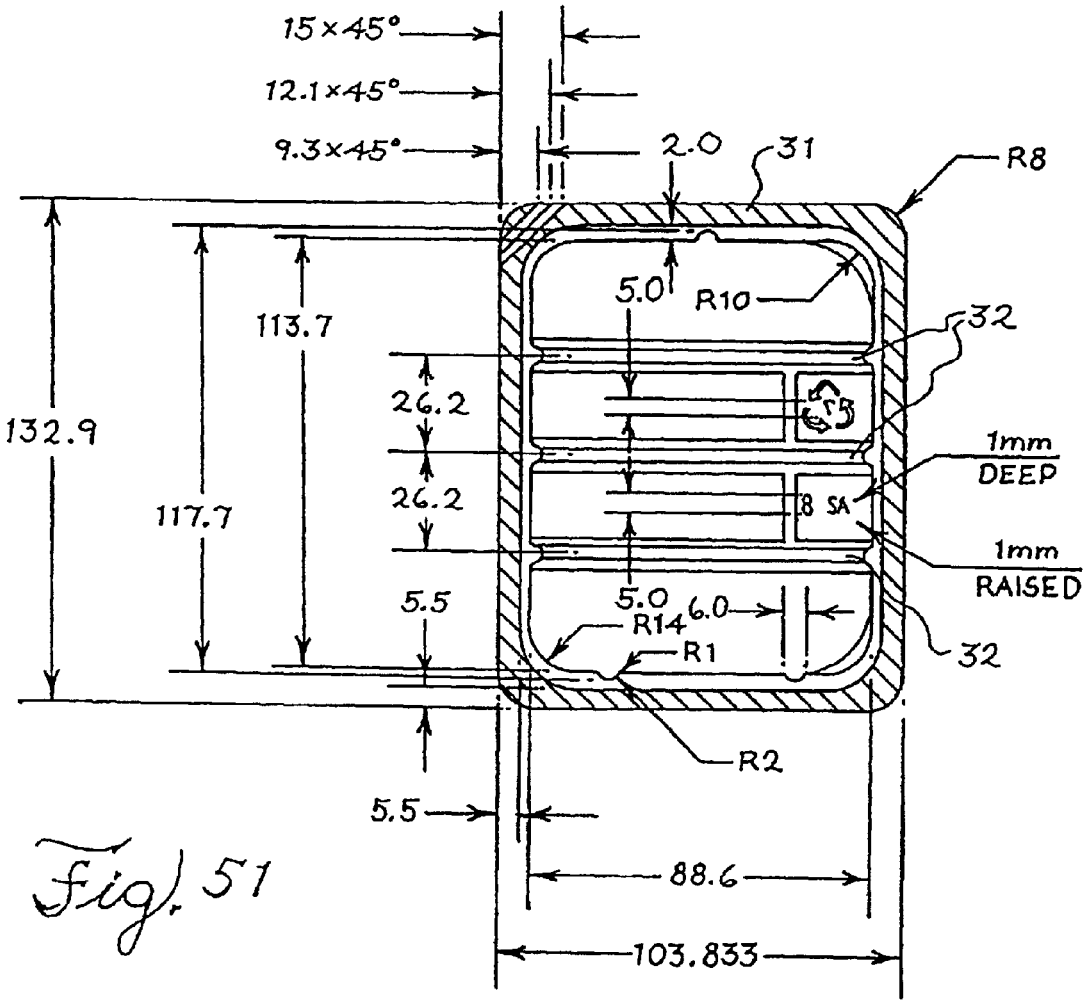
Figure 52:
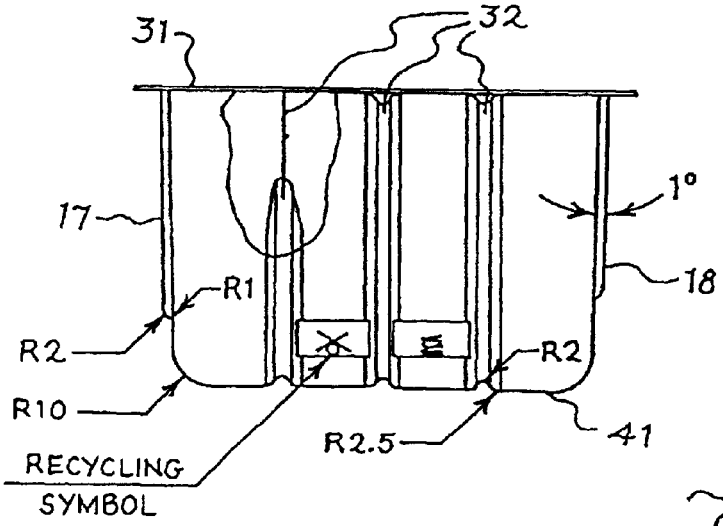
Figure 53:
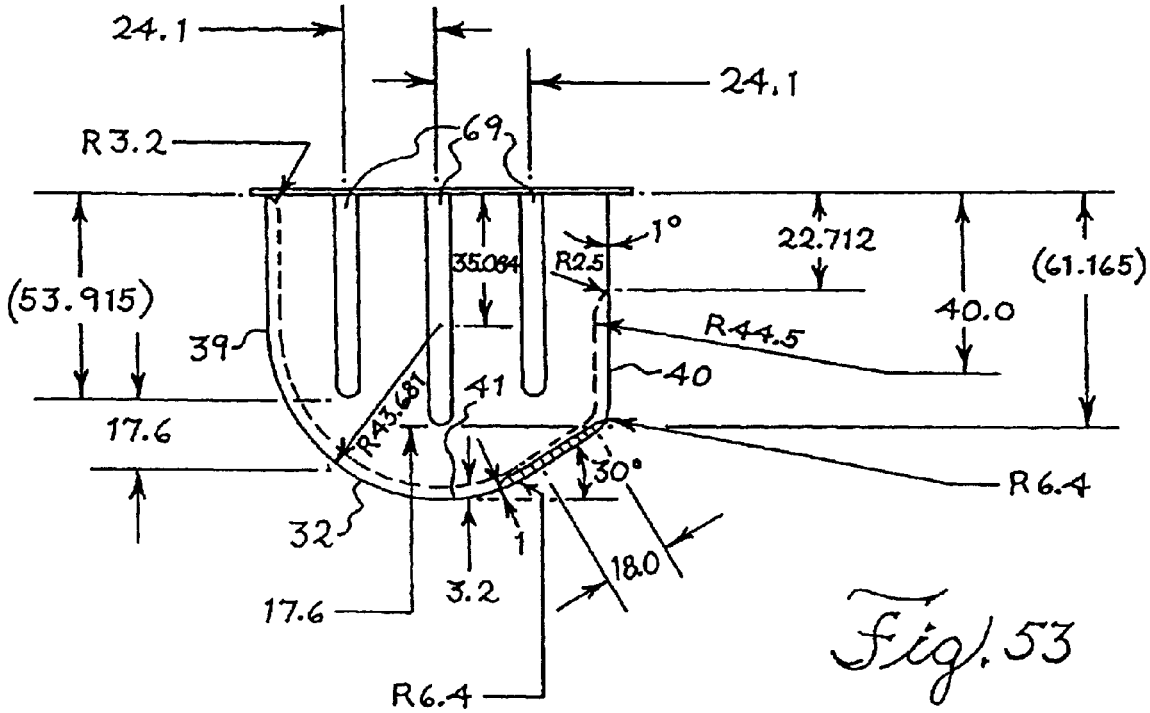

FIGS. 51–53 are views of a cartridge.

Figure 54:
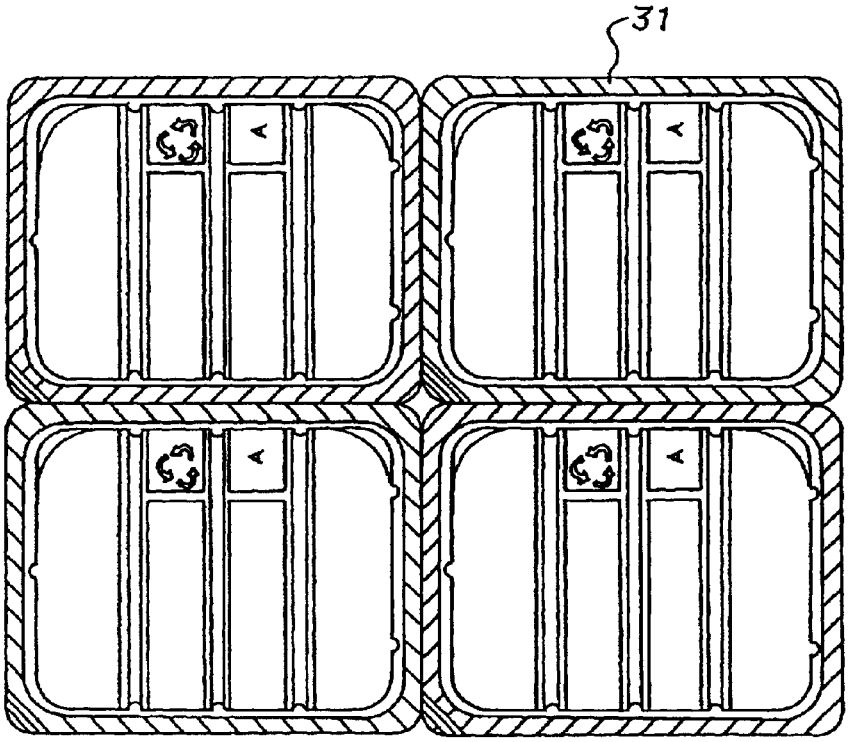

FIG. 54 is a top view of a package of cartridges.

Figure 55:
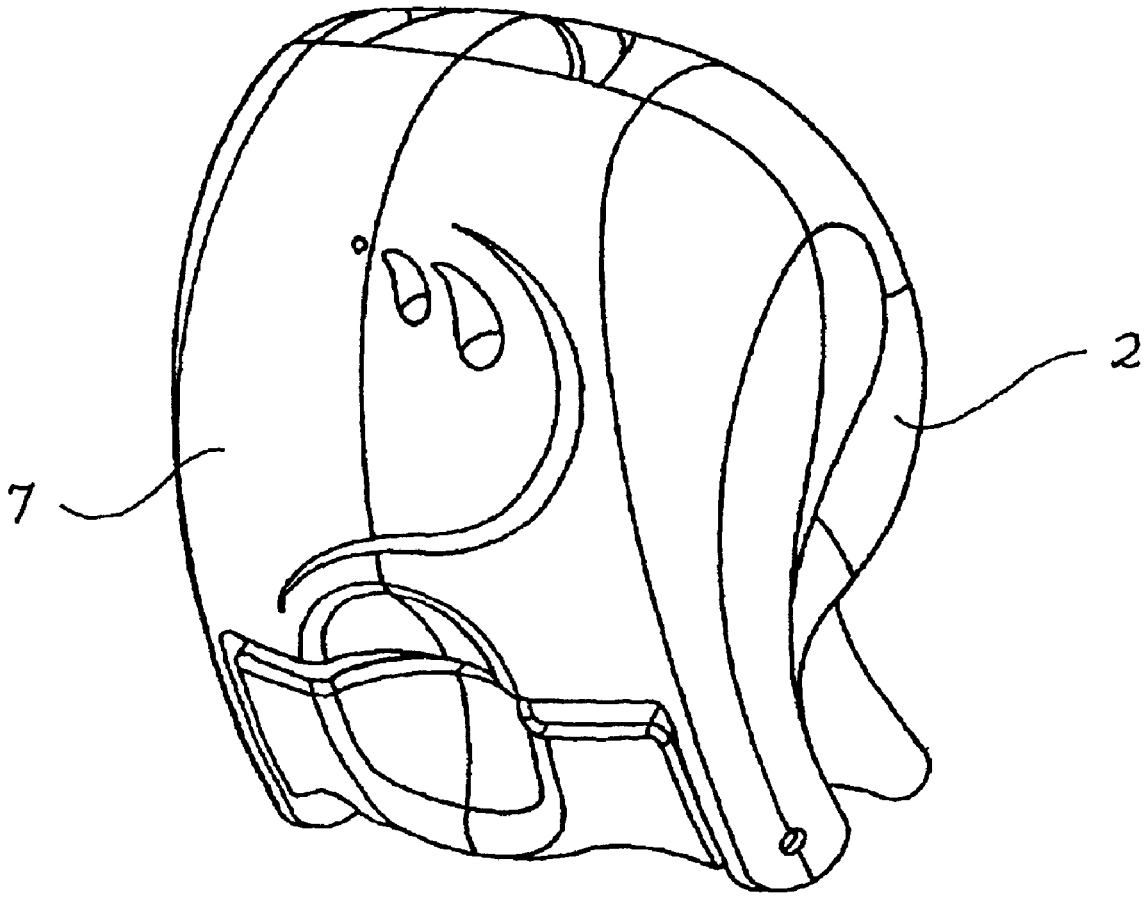

FIG. 55 is a perspective view of a dispenser.

Figure 56:
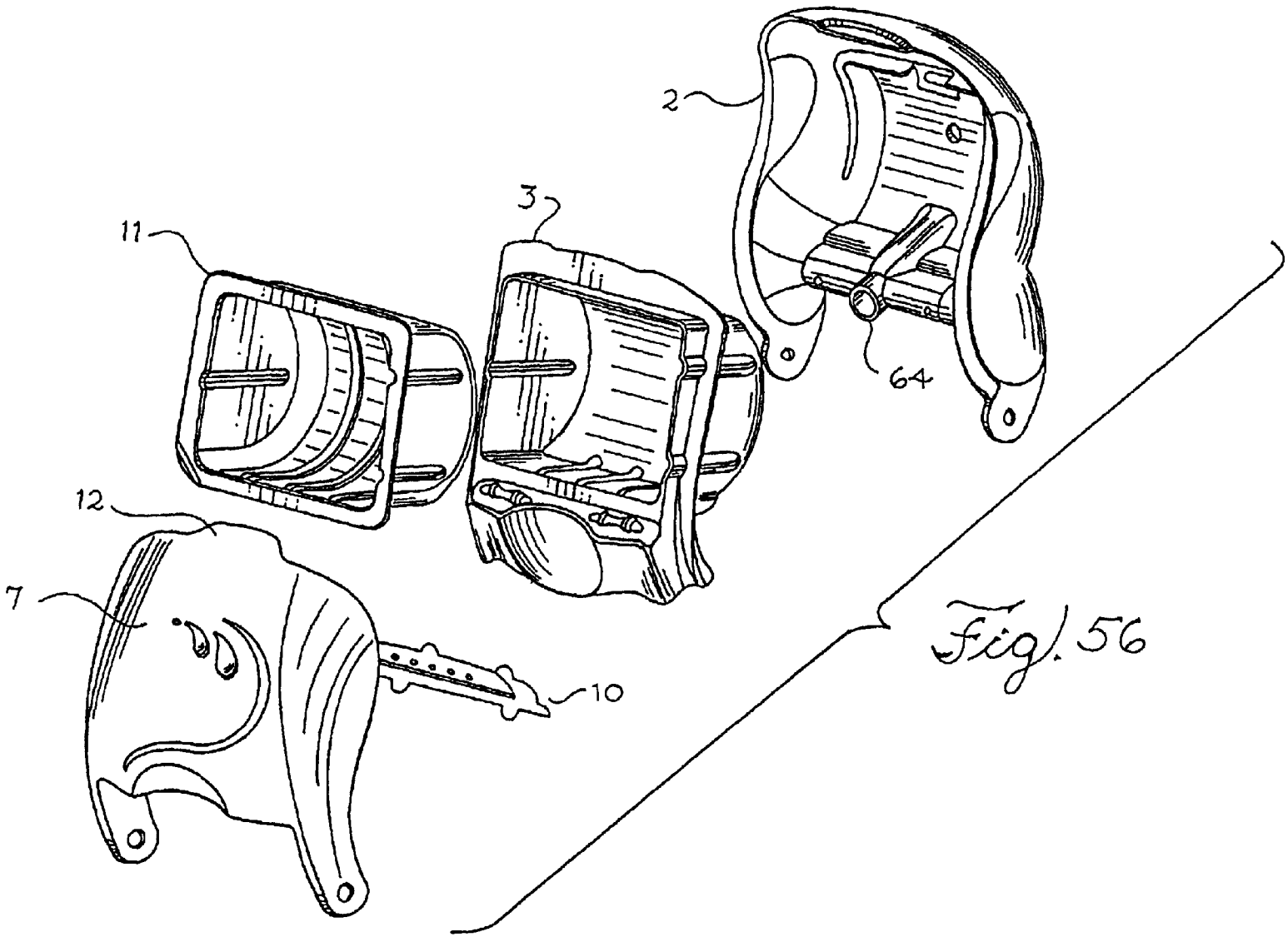

FIG. 56 is an exploded view of a dispenser and cartridge.

Figure 57:
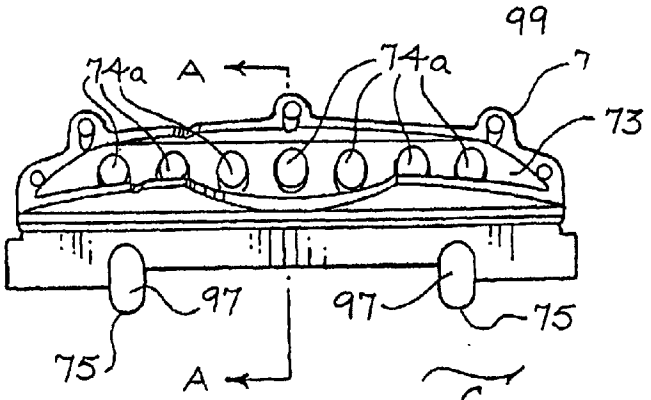

FIG. 57 is a front plan view of a wiper assembly.

Figure 58:
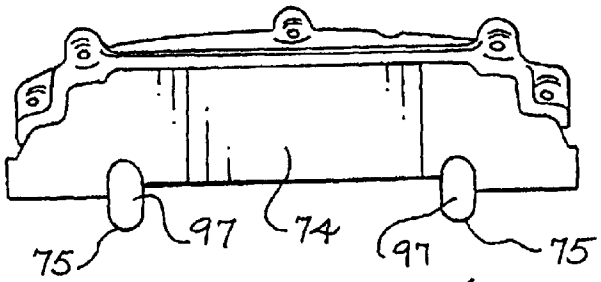

FIG. 58 is a front plan view of a wiper assembly.

Figure 59:
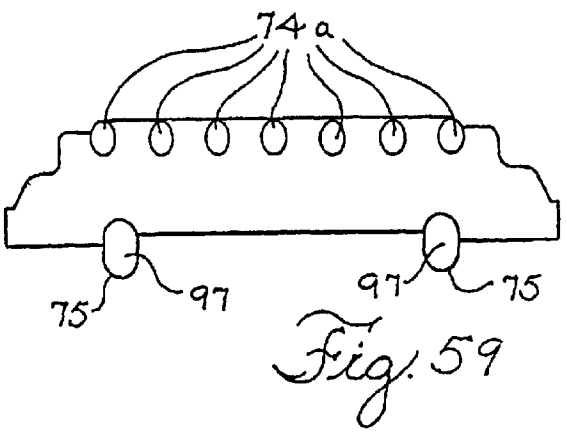

FIG. 59 is a plan view of a wiper blade.

Figure 60:
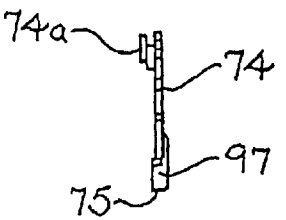

FIG. 60 is a cross-sectional view of a wiper blade.

Figure 61:
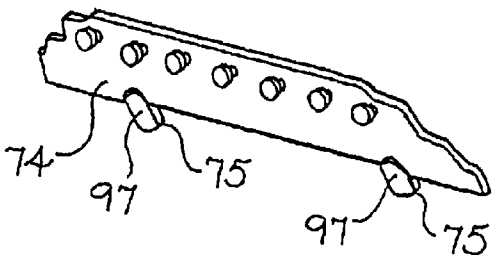

FIG. 61 is a perspective view of a wiper blade.

Figure 62:
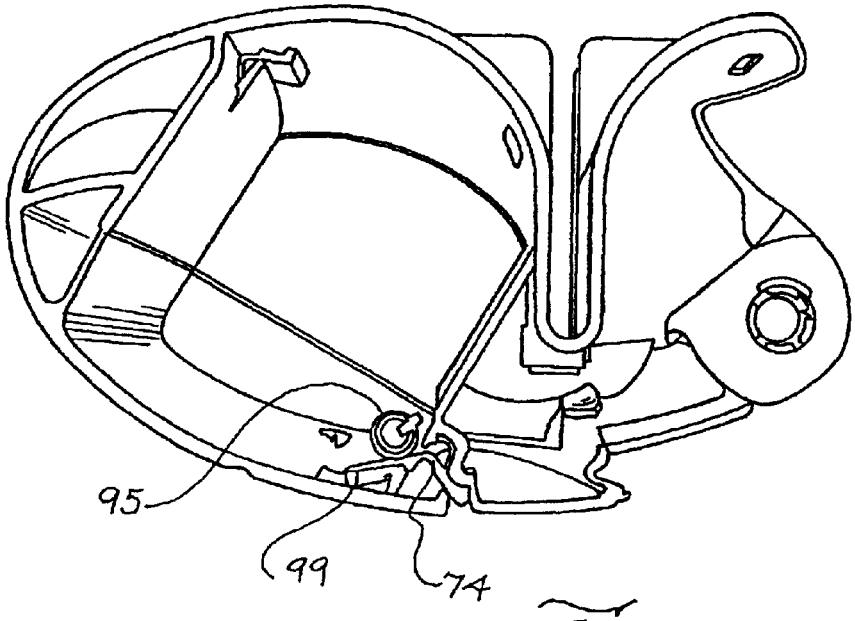

FIG. 62 is a cross-sectional view of a dispenser.

Figure 63:
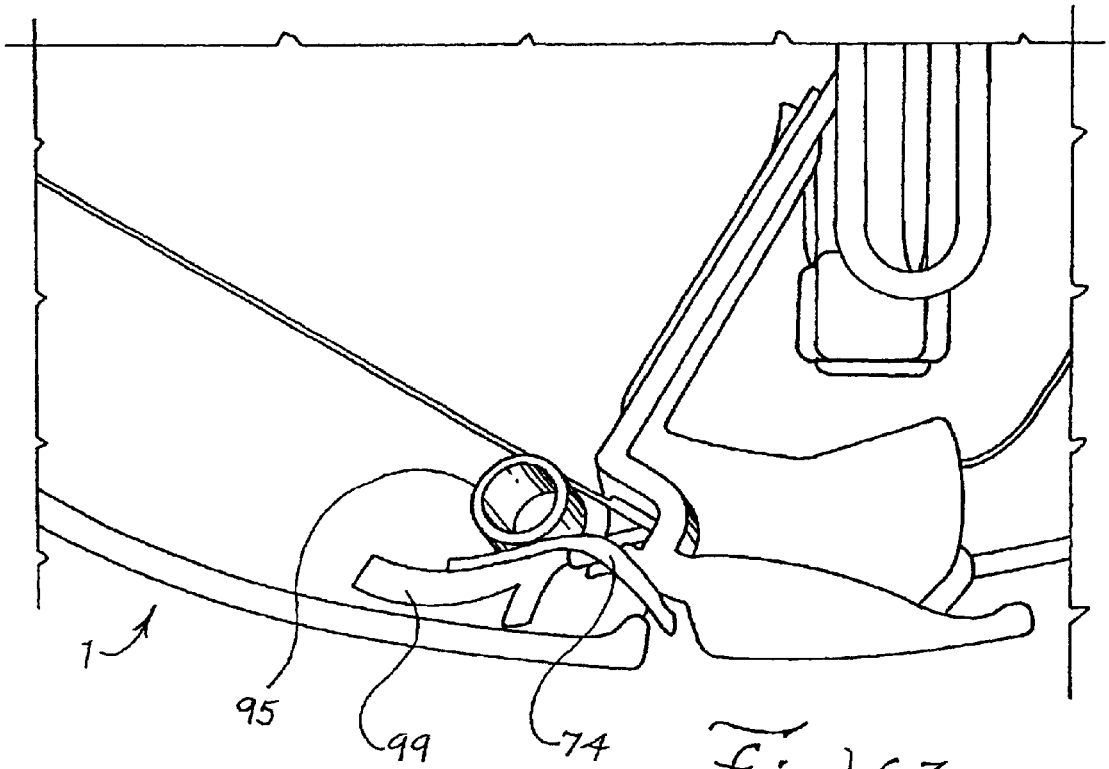

FIG. 63 is a cross-sectional view of a portion of a dispenser.

FIG. 64 is a perspective view of the inside of a cover.

FIG. 65 is a top view of the inside of a cover.

Figure 66:
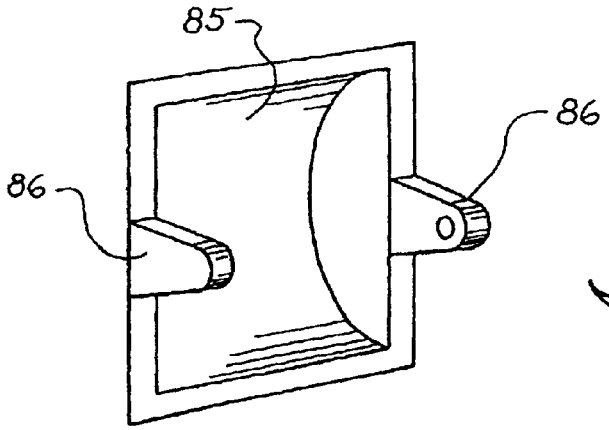

FIG. 66 is a view of a conventional bath tissue holder.

Figure 67:
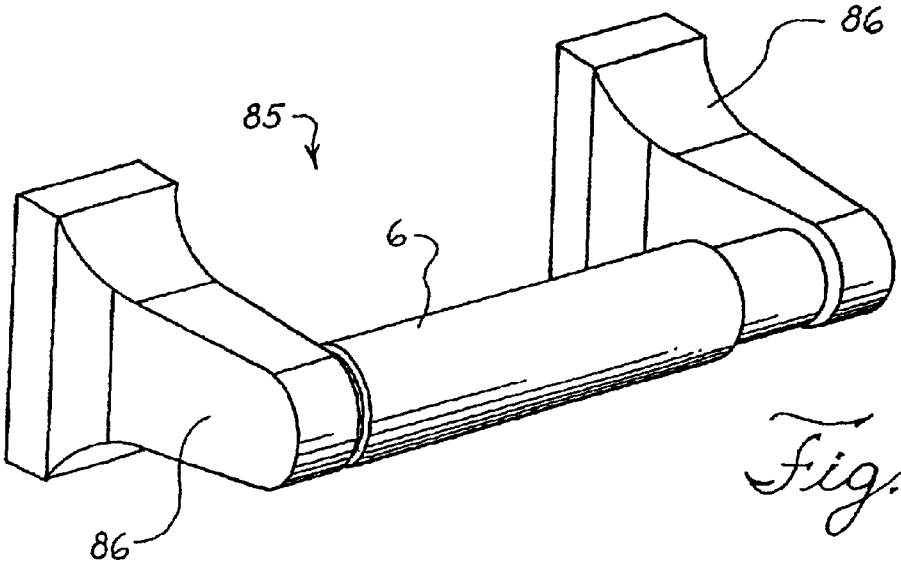

FIG. 67 is a view of a conventional bath holder.

Figure 68:
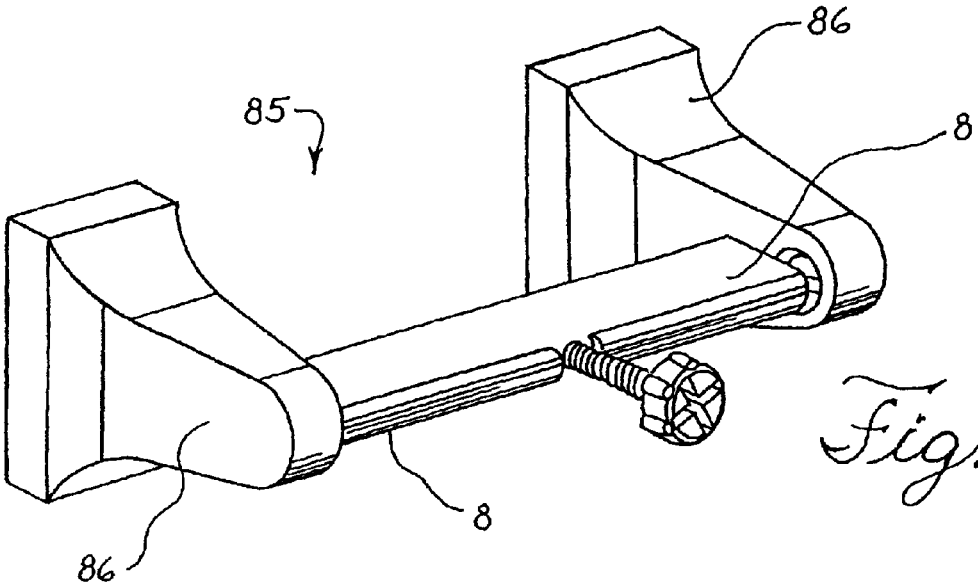

FIG. 68 is a view of a mounting assembly in a conventional bath tissue holder (shown without the dispenser).

DETAILED DESCRIPTION OF PRESENTLY PREFERRED EMBODIMENTS OF THE INVENTION

A system and method for dispensing and providing wipes is provided, which in general may have a housing, a cover, and a cartridge having a roll of wet wipes. The cartridge is placed in the housing and then the wipes can be removed from the dispenser.

Individuals, such as by way of example, Competitors to the assignee, Kimberly-Clark, can obtain samples of the dispensing systems and cartridges and wet wipes rolls disclosed herein or similar systems that may be made and sold by Kimberly-Clark. These samples may be obtained by purchasing the samples at a retail outlet or store that sells products to the general public. The price that is paid at such a store that services the general public is known as the retail price. Examples of such retail stores would be mass merchants such as Wal-Mart®, Walgreen's® and Target®, club stores such as Sam's Club® or Costco®, grocery stores such as Kroger® or Jewel®, or internet stores such as Amazon-.com® or Webvan.com®. These obtained samples can then be analyzed, such as determining their measurements, dimensions, compositions and any other information about them that is desirable. From this information dispensers systems, cartridges and rolls can be developed and made that are similar to the obtained products. For example, a cartridge or container of wet wipes can be designed and made using the data or information obtained from the obtained samples to make a cartridge of wipes that fits into the dispenser that is ordinarily used with the obtained wipes. The data and information from the obtained product may be used, in whole or in part, to make such as a cartridge. For example, and with out limitation, only the overall shape and width and length may be used. Thus, the design and dimensions of a Kimberly-Clark product could be copied and used to make a product that is placed into the stream of commerce in competition with the Kimberly-Clark product. Additionally, the price at which the Kimberly-Clark product is being offered could be obtained or discovered by the copier of the product. The price could be the retail price, i.e., the price that a consumer would pay at the point of sale, such as a grocery store or drug store. The price could also be a wholesale price or other price that is offered or paid as the products moves through the chain of distribution from Kimberly-Clark to the customer/end-user. Once these prices have been discovered, obtained or ascertained, the copier of the Kimberly-Clark product could price its product at or below the Kimberly-Clark price.

In general there is provided a device for mounting a wet wipes dispenser to another surface. That surface may be, by way of example, a wall in a bathroom, a kitchen wall, or a bathroom vanity wall. The device may be used with, or adapted for use with, most any type of wet wipes dispenser, such as the various dispensers illustrated and disclosed herein. The device is ideally adapted to work in conjunction with a conventional bath tissue holder to permit a dispenser to be securely, yet removably attached to the wall. A conventional bath tissue holder is the type that is typically found in a home. Such holders have posts that protrude from the wall and a rod or roller that is positioned between the posts. These holders may also be partially recessed into the wall. Such a holder and a holder with a mounting assembly engaged are illustrated in FIGS. 66–68. The device may also be used in the absence of a conventional bath tissue holder and may be adapted to provide that the dispenser is fixed to the wall.

For example, the system may have a dispenser that has a housing, which is capable of being mounted to a surface, such as a wall, a cabinet, an existing bath tissue dispenser, a toilet, a toilet tank, a stall wall, or a dashboard of an automobile. The dispenser has an opening that holds a cartridge, which contains the wet wipes. These cartridges are sealed and may be grouped in packages of multiple cartridges. Thus, a package of cartridges may be provided to a user. The user may then select and open one of the cartridges, put it in the dispenser, and use the wipes as needed. When the wipes are used up, the user may simply discard the old cartridge and replace it with a new one. Thus, this system enables the user to conveniently obtain and keep several cartridges of wipes on hand and then use the wipes as needed. By using sealed cartridges to refill the dispenser the user is using a new and fresh product each time and a product that is in contact with fresh surfaces.

By way of example, referring to FIGS. 1 through 15, there is provided a dispenser 1, which has a housing 2, a tray 3, a cover 7, and a mounting assembly 8. The tray and the cover form a gap 4, through which a wet wipe can extend. That portion of the wipe extending through the gap may be referred to as a tail. The tray and cover additionally have recesses 5, that form an indentation that provides a finger hold, or point where a user can grasp the wet wipe to pull it from the dispenser. Although optional, this dispenser is also provided with a roller 6 for mounting and dispensing a roll of another product, such as dry or conventional bath tissue.

In general the dispenser system illustrated herein can be used with or without conventional dry toilet or bath tissue. If conventional tissue is used with wet wipes it could be positioned in a side-by-side manner, above, or below the wet wipes.

FIGS. 1 and 4–8 show the dispenser with the cover closed. In FIGS. 4 and 6, it can be seen most easily that the dispenser generally has a top 100, a side 101, a side 102, a back 103, a bottom 104 and a front 105. FIG. 2 show the dispenser and a cartridge in a exploded view. FIG. 3 show the dispenser assembled and in a fully opened condition. The fully opened condition provides access to screw 9.

The housing may be made from any suitable material, such as plastic, wood, ceramic, porcelain, glass, paper, metal, thermoplastic elastomers, or composite materials. For example, polypropylene, polyesters such as polybutylene terephthalate (Pbt), Pbt glass filled, Pbt 15% glass filled, fiberglass, carbon fiber, and acrylonitrile-butadiene-styrene (ABS) may be used to make the housing.

The housing may have different shapes and sizes. When the dispenser is intended for use in a home it is desirable that it be of a size that is similar to conventional bath tissue roller mounts. It is particularly desirable that the dispenser be as compact as possible for home use. Further if the cover is in the range of from about 4½ inches (114.3 mm) to 6⅞ inches (174.6 mm) in width it will be able to aesthetically fit in or mount to the vast majority of toilet paper holders that are in existing houses. Preferably the width of the cover may be greater than about 3 inches (76.2 mm), less than about 6 inches (152.4 mm), less than about 7 inches (177.8 mm), and less than about 8 inches (203.2 mm). The 4½ inches (114.3 mm) by 6⅞ inches (174.6 mm) size provides an added benefit of enabling one size of dispenser to be used in the vast majority of applications in the home. Smaller sizes may be desirable for certain applications or aesthetic reasons, such as a small bathroom. The dispenser and its components may have varied colors, such as the almonds and whites that are seen in porcelain bath fixtures or may have any other desirable color. When the housing is used for industrial or institutional purposes or in commercial applications it may be desirable to make the housing substantially larger and able to hold substantially more rolls of either or both wet and dry wipes and tissue.

Figure 1:
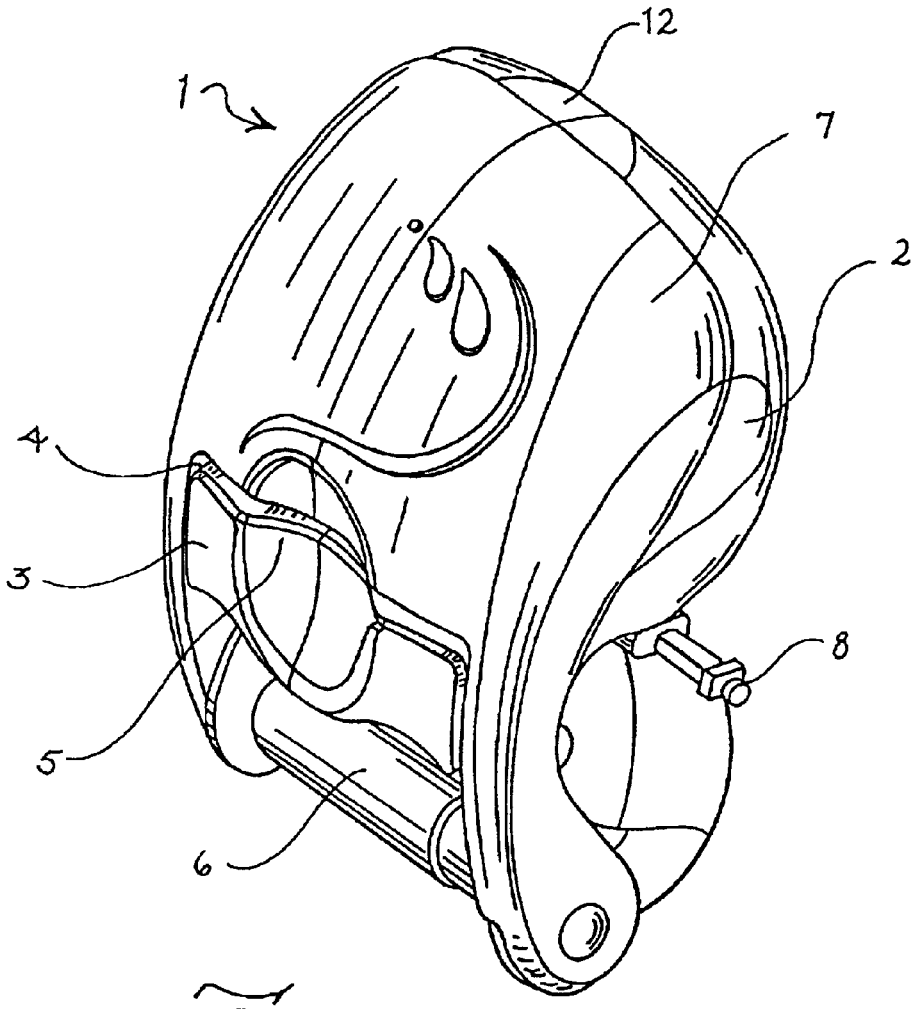
FIG. 1 is a perspective view of a dispenser.
Figure 2:
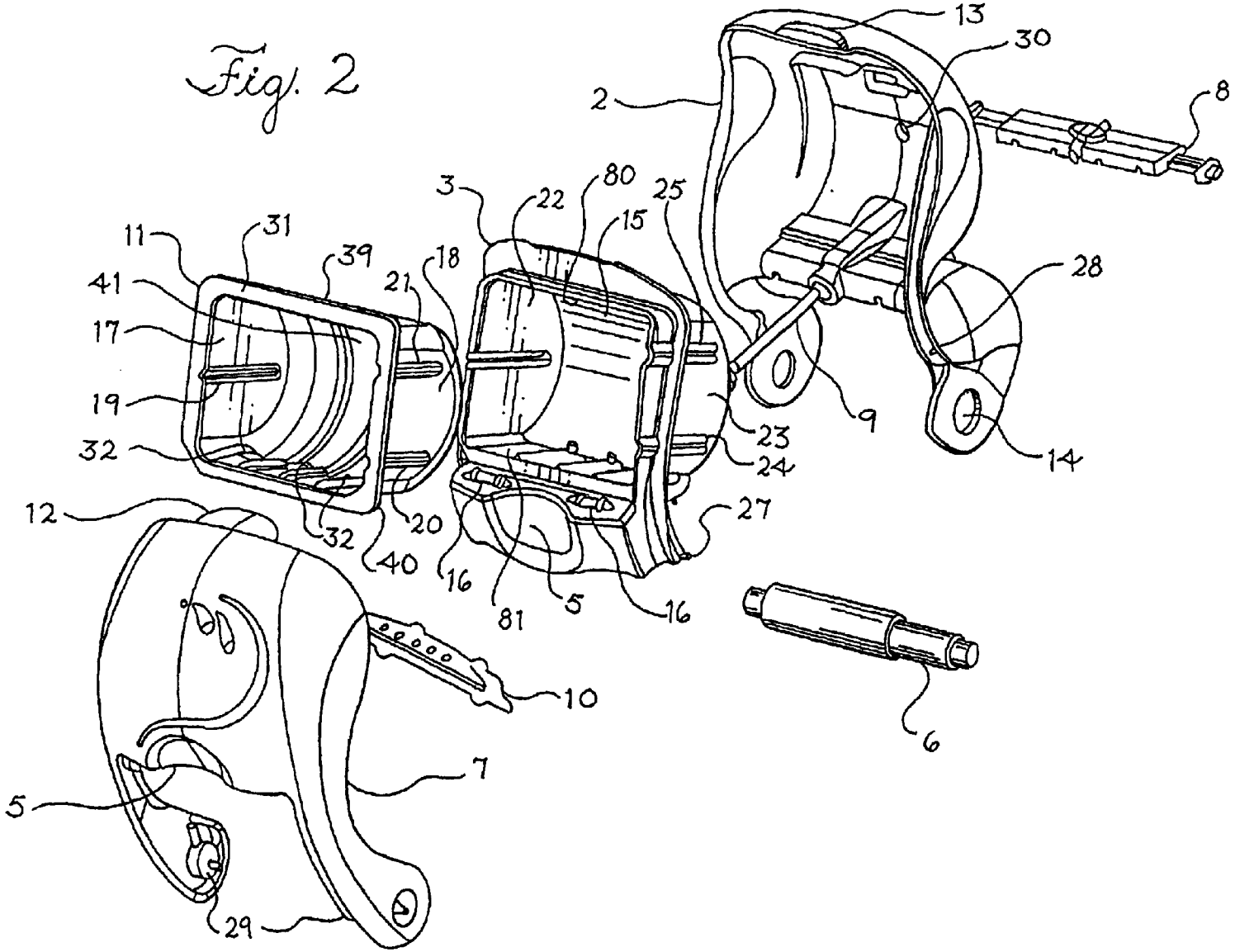

The housing may be configured as shown in FIG. 1 to mount onto or into a conventional wall mount toilet paper holder. It may also be mounted directly to a wall, for example by way of a screw, through mounting hole 30, or by other means of fixing the housing to a wall or surface, such as glue, nails, screws, rivets, magnetic attachments, staples, engaging brackets and pressure mountings against the sides of a conventional wall mount for toilet tissues. The housing also may have a lock 13 that engages a tab 12 on the cover to keep the cover closed, yet provide an easy way to open the dispenser. Various other ways to lock or fix the cover to the housing may also be employed. For example, a lock and key approach may be desirable in commercial applications or houses where there are small children present.

The housing may also have an opening 14 that is made to receive cover mounts 29. The opening 14 and the cover mounts 29 may further be configured to receive a conventional toilet tissue roller. The housing may further be configured to support a means of dispensing, storing, containing or mounting another product such as wipes, toilet tissue, or the like. For example, the housing may support a shelf which may in turn support a container of wet wipes having the same or a different composition from that of the wipes inside the housing. The housing may further have an opening 28 for receiving a pin 27 on the tray 3.

The cover 7 may be made of any similar material to the housing; it may be the same as or a different material from the housing. The cover may be clear or have a window for viewing the amount of wet wipes that remain in the dispenser. It is noted, however, that because the cover is in direct contact with the wet wipe, the cover forms the top of the cartridge when the cartridge is inserted into the dispenser and the cover closed, and wood or any other material that would support bacterial growth would not be favored. It is preferred that all materials that are in contact with the wet wipes be made from materials that discourage, or do not support bacterial growth.

Moreover, anti-bacterial agents, medicinal, botanical or skin and health agents may be added to the materials that are used to construct the components of the dispenser system, including by way of example the dispenser housing, the tray, the wiper blade, the wiper assembly, the cartridge, the cover and the gaskets. In particular any component that is in contact or associated with the wet wipes may have such an agent added to it.

The cover is designed to cooperate with the cartridge 11 to form a barrier to moisture loss from the wet wipes. The cover may also be designed to cooperate with other components of the dispenser system to form a moisture barrier. The dispenser can maintain wet wipes in a moist condition when fully closed for at least 1 day, for at least 2 days, for at least 5 days and for at least 14 days, and preferably for more than 14 days at room conditions of 73° F. (22.8° C.) and 50% relative humidity. The dispenser when fully closed can maintain at least about 15%, at least about 20%, at least about 25%, at least about 50%, and at least about 95% of the moisture of the wipes for a 14 day period at 73° F. (22.8° C.) and 50% relative humidity. These moisture retention values can be obtained with a tail of the wipe protruding through the gap, the tail having a length of not more than 1.5 inches (38.1 mm).

The cover may further be designed to cooperate with the cartridge 11, or other components of the dispenser system, to form a barrier to contamination of the wipes within the dispenser. Thus, the cover in cooperation with the cartridge, or other components of the dispenser system, may form a barrier to dirt, dust, mold spores and bacteria.

The space between the inner surface of the front cover and the surface of the lip of the cartridge may vary between about 2 mm and about 10 mm. In this way there is formed a dome above an open cartridge that at least partially covers that opening, which dome is preferably less than about 15 mm, less than about 10 mm, less than about 5 mm and ideally is less than about 2 mm above the lip of the cartridge. The height of the dome may also be measured from the surface of a full roll of wet wipes in which an additional 2 to 7 mm may be added to the height of the dome. Higher domes may also be employed, but such higher domes may be less aesthetically pleasing and may provide for greater amounts of evaporation or moisture loss from the wet wipes.

The cover may be provided with an inside rim 33 (see, e.g., FIG. 3) and a wiper 10 (see, e.g., FIGS. 2 and 3). The cover inside rim and wiper cooperate with the lip 31 of the cartridge. In this way when the cover is closed the inside rim is brought against the lip of the cartridge and the wiper is similarly brought against the tray including the guides, as well as the lip of the cartridge. In a further embodiment, the cover may be provided with a lip, and the cartridge may be provided with a rim to facilitate the cooperation.

The distance between the inside of the cover where the wiper is located and the tray may be less than the height of the wiper blade. Thus, in this configuration the wiper blade would be placed under compression against the lip, the tray, or the guides 16 or all of them depending on the position of the wiper. Here the wiper blade would exert pressure on the wet wipes. The wiper may also be positioned so that it contacts the wet wipe but does not exert pressure against it, or be positioned so that it is a short distance above the wet wipe. The amount of pressure that the wiper exerts on the wet wipe may vary depending upon several factors, including the purpose for the wiper, the material that the wiper blade is made from, the material that the wet wipe is made from and the material that the cartridge lip 31 is made from.

The tray 3 may be made from any similar material to the housing or cover, and it may be the same material or different material from those of components. The tray may have side walls 22, 23, 80 and 81. Walls 22 and 23 correspond to the sides of the dispenser, wall 80 corresponds to the top of the dispenser, and wall 81 corresponds to the bottom of the dispenser. The tray shown in the figures does not have a back wall, although one may be provided if desired. The side walls may be provided with recesses 24, 25, and 26. These recesses cooperate with protrusions 19, 20 and 21 on the cartridge (19 with 26, 20 with 24 and 21 with 25). In this way the cartridge is securely, yet easily removably held in the dispenser. The tray opening 15 is sized in relation to the cartridge (or the cartridge may be sized in relation to the tray opening) so that the cartridge can easily be slid into and out of the dispenser.

The tray and cartridge together result in a keyed type arrangement that allows the cartridge to be inserted fully or properly in only one orientation into the dispenser. Thus the two elements fit together in a manner similar to a lock and key. This assures that the roll of wipes will unwind from a predetermined orientation, i.e., from the bottom of the roll or the top of the roll. As is apparent from FIG. 2 the tray opening and cartridge are not symmetrically shaped. This asymmetry provides for the keyed arrangement. An object is considered symmetrical if there can be a plane which passes through the object such that the portions on either side of the plane are reflections of each other.

In the embodiment shown in FIG. 2 the asymmetry in the vertical plane is obtained by having a different number and location of protrusions and recesses on opposite sides. It is recognized that any suitable means to accomplish asymmetry may be employed, such as notches, tongue and groove, or the shapes of the opening and detents. For example, some of the cartridge walls may be flat while others are rounded, or the cartridge lip may be non-planar. Additionally, labeling or marking of the cartridge, the tray, or both can create the effect of asymmetry.

The housing may further have guides 16. The guides may be movable or fixed. The guides may have raised surfaces 16*a* and lowered surfaces 16*b*. These guides may be made from the same type of material as the housing. They may be integral with the housing. The guides and the housing may be one continuous piece of plastic. The guides may be designed to cooperate with the wiper to prevent or reduce the tendency of the wipe to skate to one side of the dispenser as the wipe is pulled out and torn off. The guides may also cooperate with the wiper to regulate and control the amount of drag. The tray may have barbs 71 to discourage the placement of wet wipes directly into the dispenser without the use of a protective package, a practice which could cause premature drying of the wet wipes or could allow the growth of bacteria and/or mildew in the wipes. An example of tray without barbs is seen at FIG. 26.

The cartridge may be made out of any suitable material, such as plastic. It is preferable that the cartridge be made from a light weight, inexpensive, disposable and recyclable material. The cartridge has side walls 17, 18, 39 and 40 and bottom wall 41. The cartridge has a lip 31 that forms an opening at the top of the cartridge. The cartridge has ribs 32. The ribs may extend part way or all the way along the sides 39 and 40 and the bottom 41. The ribs 32 may cause grooves or indentations to form in the rolls, depending on the density of the roll and conditions of use. These grooves are not necessary to the use of the dispenser system. The curvature of the cartridge bottom is between 40 and 45 degrees, preferably between 42 and 44 degrees.

The cartridge may be any shape or size provided that it fits in or cooperates with the dispenser. For example a cartridge that would be useful for application in the home would have side walls 17 and 18 that are less than 105 mm and side wall 39 and 40 that are less than 134 mm.

Instead of protrusions 19, 20 and 21, the cartridge may have recesses at those locations, and the tray may have corresponding protrusions. Moreover, the cartridge may have ribs, like rib 32, along side walls 17 and 18.

The cartridge may have a lid or cover with a removable strip. Removal of this strip would result in a gap through which the wipes can be dispensed. In this configuration, it may be useful to attach the tail of the wipes to the strip. In this way, removal of the strip facilitates the threading of the wipes through the gap. The cartridge may also have a removable seal over the cover.

The container for the wet wipes may also be flexible. A flexible package made of plastic, metal foil, paperboard or combinations thereof may be used to seal the wipes in a wrapper or may be configured as a pouch with a removable cover. Any material and configuration that prevents the loss of moisture from the wet wipes may be used to package the wipes. A removable cover may contain a removable strip to facilitate dispensing of the wipes. The cover may also contain a lip to cooperate with the cover inside rim and the wiper. The combination of the wipes and the container may be the same size as or smaller than the cartridge so as to fit within the tray.

FIG. 16 shows a dispenser in the closed condition with a tail of a wet wipe 36 protruding from gap 4 into the finger hold indentation that is formed by recess 5. In use the tail of the wet wipe would be grasped and pulled generally in the direction of arrow 35 causing the roll to unwind and the wipe to be dispensed from the dispenser. In use the wet wipe may also be subjected to forces tangential and perpendicular to the direction of arrow 35. If these forces occur the guides and the wiper help to prevent the wipe from skating to one side of the gap and bunching up or binding.

FIG. 17 is an exploded view of a dispenser, cartridge and roll of wipes 34 showing the relationship of these components.

FIG. 18 shows a roll of wipes 34 that has a tail 36 and further defines the axis of the roll as 37. Rolls useful with this dispenser or as part of a dispensing system may contain from as little as a few linear inches (or cm) to more than 450 linear inches (11.43 m), to more than linear 600 inches (15.24 m) to more than a thousand linear inches (25.40 m) of wet wipes. The rolls may have a web of material that may have any number of sheets. Usually, the sheets are separated by perforations that enable the sheet to be easily torn from the web but are strong enough that they will not separate while the web is being pulled from the dispenser. An example of a roll that is particularly useful for applications in the home is one that has a diameter of about 2 inches (50.8 mm) to about 3 inches (76.2 mm), of about less than 5½ inches (139.7 mm), and preferably has a diameter of about 3 inches (76.2 mm) and more preferably of about 2⅞ inches (73.0 mm). This roll has from about 400 linear inches (10.16 m) of wipes to about 1000 linear inches (25.40 m) of wipes. Without limitation, each sheet length may be from about 3 inches (76.2 nm) to about 10 inches (254.0 mm) and preferably are about 4.5 inches (114.3 mm). This roll may further have a density of from about 0.3 g/cc to about 1 g/cc, from about 0.5 g/cc to about 1 g/cc and preferably about 0.62 g/cc. A particular example of a roll may be one having a diameter of about 2 inches (50.8 mm) and containing about 450 linear inches (11.43 m) of wipe. Another particular example of a roll may be one having a diameter of about 3 inches (76.2 mm) and containing 450 linear inches (11.43 m) of wipes.

The preferred form of wet wipes for use with the dispenser system is a solid coreless roll as shown in FIG. 18. It is to be understood, however, that cored rolls (hollow cores, solid cores and partially solid cores), hollow coreless rolls, and stacks of sheets may also be used in the dispenser system. When density values are referred to herein, it is for the density of the roll and this would exclude any void, for a coreless hollow roll, or space occupied by a core for a cored roll.

Various tests and observations of physical properties are reported in Tables I, II, III, and IV.

Solution add-on level is the amount of solution by weight divided by the amount of dry wipe by weight multiplied by 100 to provide a percentage value.

Base sheet converting refers to the width of the roll and the sheets in the roll, i.e., along axis 37 of the roll in inches.

Perforation refers to the amount of cutting and the distance between the cuts in the perforation that separates the sheets in a roll. There are three parameters to this measurement: cut length, bond length and bond spacing. The bond spacing is equal to the sum of the cut length plus the bond length. By way of example, perforations that are useful with wet wipes are ones that have a bond length of 0.02 inch (0.51 mm), a cut length of 0.05 inch (1.27 mm), and a bond spacing of 0.07 inch (1.78 mm), or one that has a bond length of 0.04 inch (1.02 mm), a cut length of 0.09 inch (2.29 mm) and a bond spacing of 0.13 inch (3.30 mm).

Dry basis weight is the basis weight of the wipe before the solution is added to the wipe, i.e., before it is wet.

Wet thickness is the thickness of a wet wipe, i.e., after the solution has been added to it, in mm.

Sheet count is the number of sheets in a roll, i.e., the number of sheets created by the perforations.

Although all tests are done under TAPPI standard test conditions, the wet wipes are not equilibrated to those conditions. Instead, the wipes are removed from a sealed container or cartridge and tested within a few, generally less than 5–10, minutes after opening. This is about a 5 minute variation in this time period that the wet wipe is exposed to the atmosphere, which does not materially or significantly alter the test results.

Tensile, stretch and TEA (total energy absorbed) values were obtained on the wet product following ASTM 1117-80, section 7, with the following modifications: sample dimensions were 1+/−0.04 inch (25.4 +/−1.0 mm) wide and 4.25 +/−0.04 inches (108.0 +/−1.0 mm) wide; initial gauge length was 3+/−0.04 inches (76.2 +/−1.0 mm); test speed is 12 inches/minute (305.0 mm/min).

MD tensile is the peak load before failure per inch width of the sample, as determined in the machine direction. CD tensile is the peak load before failure per inch width of the sample, as determined in the cross direction. MD stretch is the percentage of elongation the wipe has in the machine direction at the peak load. CD stretch is the percentage of elongation of the wipe in the cross machine direction at the peak load. Total Energy Absorbed (TEA) is the area under the force-elongation curve (in units of lb. and ft., respectively) from the start to the failure point divided by the initial surface area of the sample between the upper and lower grips. For these samples, this surface area was 3 sq. inches (19.4 $cm^2$). Ten specimens were tested for each code, and the average was calculated and reported. The test can be carried out on a standard tensile tester such as a MTS Sintech 1/G test machine with TestWorks 3.10 software. Both the Sintech test machine and the TestWorks software are available from MTS Corporation located at 1400 Technology Drive, Eden Prairie, Minn.

Detach refers to the force in grams per sheet that is required to break a perforation, i.e., the amount of force required to separate two sheets in a roll along the perforation. These properties were determined using a MTS Sintech 1/G test machine with TestWorks 3.10 software. Two sheets were removed from a roll. The sheets had a width of 4.25 inches (108.0 mm), and were connected by perforations along the width. The sheets were folded in half along the length such that the width of the sample was 2⅛ inches (54.0 mm). The top and bottom of the sample were placed in grips having an internal spacing of 2 inches (50.8 mm), such that the perforation line was centered between the upper and lower grips. The upper grip was then displaced upward (i.e. away from the lower grip) at a rate of 10 inches/minute (254.0 mm/min) until the sample was broken along the perforations. The applied force and sample elongation were measured throughout the test. The peak load from the force-elongation curve is recorded so that the detach strength is expressed in units of grams/sheet. The average results from ten samples are reported.

Percentage strain at peak load ("% strain@ pk load") was determined from the results of the test described above. The elongation at the peak load is divided by the initial sample length of 2 inches (50.8 mm), and the result is designated the % strain@ peak load. The average results from ten samples are reported.

Wet thickness refers to the thickness of a wipe that is measured while the sample is subjected to a specified load or weight. The wet thickness of wet wipes and wipes before wetting are reported in Table II. These values are based on samples measuring 3×4 inches (76×102 mm) that were individually placed under a confining load of 0.05 pounds/square inch (psi) (345 Pa). The region of the sample that was tested was free of wrinkles and folds. A Starrett Comparator Base Model 653G was used to perform these tests available from Starrett, 121 Crescent St., Athol, Mass. 01331. This base is precision ground to be flat (tolerance of +/−0.001 inch, +/−0.025 mm). A digital displacement indicator (Sony model U30-1 SET) was attached to the base via a cantilevered horizontal control arm supported by a vertical shaft. The indicator measures vertical displacement relative to the comparator base to within 0.001 inch (0.025 mm). The load was applied by an acrylic contact foot attached to a vertically traveling spindle shaft that descended to the comparator base. The foot has a diameter of 3.00 inches (76.2 mm), a height of 0.63 inch (16.0 mm) and is flat on the lower surface to a tolerance of +/−0.001 inch (0.025 mm). The weight of the contact foot, spindle, and the associated hardware, not including the contact force springs in the indicator, is 160.5 +/−0.1 g. The spindle shaft descends to the comparator base with a travel time of 0.5 seconds to 0.75 seconds. The thickness was measured by the indicator as the height of the wipe relative to the surface of the comparator base immediately after the load pressure of 0.05 psi (345 Pa) was applied for 3 seconds. Calibration before testing was performed on a set of standard samples traceable to the National Bureau of Standards.

By way of example and without limitation, wet wipes useful in the present dispensing system may have a dry basis weight from about 10 to about 200 gsm, a dry thickness from about 0.5 to about 2 mm, a wet (i.e., wipe with solution or wetting material added) thickness from about 0.3 to about 0.7 mm, a MD wet tensile at least about 250 g/inch (9.8 g/mm), a CD wet tensile at least about 200 g/inch (7.9 g/mm), a MD wet stretch from about 5% to about 30%, a CD wet stretch from about 5% to about 36%, a TEA MD wet strength of from about 0.5 to 2 ft-lb/sq. inch (0.10 to 0.4 J/cm$^2$), a TEA CD wet strength of from about 0.5 to 2 ft-lb/sq. inch (0.10 to 0.4 J/cm$^2$), and a solution add-on of about 150–350%.

Peel force measures the amount of force in grams/4.25 inches (g/108.0 mm) required to unroll a roll of wet wipes, i.e., the grams required to unroll a roll that is 4.25 inches (108.0 mm) wide. Thus, these values could be normalized to apply to any width roll in grams/inch of roll width basis. The peel force, as reported in Table II was the force required to unroll a roll as it was resting in an open cartridge and was measured with an MTS Sintech 1/G test machine with TestWorks 3.10 software. A 4.5-inch (114.3 mm) wide clamp with rubber surfaces gripped the tail of a roll, with the roll positioned directly underneath the clamp such that the tail would remain vertical as it was unwound from the roll. The clamp was attached to the crosshead, which pulled the tissue web upward at a speed of 100 cm/minute. Peel force was measured by a 50 Newton load cell. The average load to pull 18 to 20 sheets away from the roll was recorded by averaging two runs in which 4 sheets each were separated and two runs in which 5 sheets each were separated. Only the first 18 to 20 sheets from the roll were used to obtain the measurements of Table II.

The dispensing force, which is the force to pull the wet wipes from the dispenser, may also be determined. This force can be measured with a MTS Sintech 1/G test machine equipped with TestWorks 3.10 software. A clamp with rubber surfaces grips the tail of a roll of wet wipes placed in a dispenser. The initial distance between the clamp and the platform where the dispenser sits is about 12 inches (304.8 mm). The dispenser is placed underneath the clamp. The clamp is attached to the crosshead, which pulls the roll upward at a speed of 100 cm/min. The pull force is measured by a 50 Newton load cell. For each run, the pull force as a function of pull distance curve for pulling 4 sheets away from a roll is recorded using the TestWorks 3.10 software. Based on the curve, the average pull force for each run is calculated. The average load of five runs is used to represent the dispensing force of a given roll. Only the first 23 to 25 sheets from the roll were used to obtain the measurement.

Table I sets out types of wet sheets and their properties. In Example 1, the solution was a sufficient amount of commercial (no salt) solution such as that which is used in the commercially available KLEENEX® brand COTTONELLE® flushable moist wipes product of Kimberly-Clark Corporation. In Example 2, the solution was a sufficient amount of 4% salt water solution such as a simple 4% salt water solution with other additives as disclosed in the examples of wet wipe applications discussed previously in the Background of Invention, all of which have been and are incorporated herein by reference.

TABLE I

| | Non-Dispersible Wet Wipe Example 1 | | Dispersible Wet Wipe Example 2 | |
|---|---|---|---|---|
| Basis Weight | 60 gsm | | 60 gsm | |
| Solution | commercial (no salt) | | 4% salt solution | |
| Solution Add on level | 175% | | 228% | |
| Basesheet Converting | 4.25" width | | 4.25" width | |
| Perforation Bond Spacing | 0.11" | | 0.07" | |
| | Run Average | Run STDev | Run Average | Run STDev |
| Dry Basis Weight (gsm) | 57 | 2 | 66 | 4 |
| Wet Thickness (mm) | 0.56 | 0.02 | 0.47 | 0.01 |
| Sheet Count | 99 | 0.7 | 99 | 1.1 |
| Wet tensiles | | | | |
| MD Tensile (g/in) | 380 | 26 | 321 | 30 |
| MD Stretch % Elongation | 23 | 1.4 | 28 | 1.6 |
| TEA (Ft-Lb/Sq.in) | 0.96 | 0.06 | 1.02 | 0.07 |
| CD Tensile (g/in) | 329 | 28 | 287 | 29 |

TABLE I-continued

| | Non-Dispersible Wet Wipe Example 1 | | Dispersible Wet Wipe Example 2 | |
|---|---|---|---|---|
| CD Stretch (% Elongation) | 28 | 1.8 | 34 | 3.5 |
| TEA (Ft-Lb/Sq.in) | 0.93 | 0.09 | 0.97 | 0.13 |
| Detach (g/sheet) | 752 | 21 | 853 | 34 |
| % strain @ pk load | 8 | 0.5 | 11 | 1.1 |

Table II contains additional data reflecting the properties of disposable wet wipes. This table shows the effects that changing base sheet and solution variables has on the physical properties of the wipes. The pulp used to make these sheets was Weyerhauser CF 405. For this example, the binder was example Code E, Table 15, of Ser. No. 09/564, 531. This binder material had a molecular weight of 610,000 and was made from the following monomers provided in the following weight percents: 60% acrylic acid, 24.5% butacrylic acid, 10.5% 2-ethylhexyl-acrylic acid, and 5% AMPS (2-acrylamido-2-methyl-1-propanesulfonic acid).

TABLE II

| Basesheet Variables | 100% pulp/ 65 gsm 22% binder/1.1 mm dry thickness | 100% pulp/ 60 gsm 20% binder/.76 mm dry thickness | 100% pulp/ 55 gsm 20% binder/.76 mm dry thickness | 15% PET/ 55 gsm 20% binder/.84 mm dry thickness |
|---|---|---|---|---|
| | Solutions 0.5% silicone; 0.25% lanolin | | | |
| | Example 3 | Example 4 | Example 5 | Example 6 |
| MD Wet Tensile (g/1") | 500 | 452 | 383 | 391 |
| CD Wet Tensile (g/1") | 445 | 403 | 344 | 310 |
| wet thickness (mm) | 0.46 | 0.40 | 0.39 | 0.41 |
| peel force | 167 | 131 | 106 | |
| | Solutions 1.0% silicone; 0.25% lanolin | | | |
| | Example 7 | | Example 8 | Example 9 |
| MD Wet Tensile (g/1") | 473 | | 401 | 416 |
| CD Wet Tensile (g/1") | 455 | | 348 | 350 |
| wet thickness (mm) | 0.45 | | 0.40 | 0.39 |
| peel force | 170 | | 120 | 115 |
| | Solutions 1.0% silicone; 0.0% lanolin | | | |
| | Example 10 | | | |
| MD Wet Tensile (g/1") | 528 | | | |
| CD Wet Tensile (g/1") | 462 | | | |
| wet thickness (mm) | 0.44 | | | |
| peel force | 162 | | | |

Table III sets out the physical properties of rolls of wet wipes and Table IV sets out the theoretical physical properties of rolls of wet wipes.

TABLE III

Coreless Roll Measurements and Calculations

| Roll Number | Measured Diameter (inches) | Unwound Wet Thickness (mm) | Calculated Roll Density ($g/cm^3$) | Calculated Effective Thickness (mm) | Compression Factor (%) |
|---|---|---|---|---|---|
| 1 | 2.77 | NA | 0.621 | 0.340 | 71% |
| 2 | 2.83 | 0.41 | 0.595 | 0.355 | 74% |
| 3 | 2.86 | NA | 0.583 | 0.362 | 76% |
| 4 | 2.90 | NA | 0.567 | 0.373 | 78% |
| 5 | 2.96 | 0.478 | 0.544 | 0.388 | 81% |
| 6 | 2.86 | NA | 0.583 | 0.362 | 76% |
| 7 | 2.98 | NA | 0.537 | 0.393 | 82% |
| 8 | 2.88 | NA | 0.575 | 0.368 | 77% |
| 9 | 2.94 | NA | 0.552 | 0.383 | 80% |
| 10 | 2.86 | 0.448 | 0.583 | 0.362 | 76% |
| 11 | 2.86 | NA | 0.583 | 0.362 | 76% |

TABLE III-continued

Coreless Roll Measurements and Calculations

| Roll Number | Measured Diameter (inches) | Unwound Wet Thickness (mm) | Calculated Roll Density ($g/cm^3$) | Calculated Effective Thickness (mm) | Compression Factor (%) |
|---|---|---|---|---|---|
| 12 | 2.84 | NA | 0.591 | 0.357 | 74% |
| 13 | 3.00 | NA | 0.530 | 0.399 | 83% |
| 14 | 2.86 | NA | 0.583 | 0.362 | 76% |
| 15 | 2.86 | NA | 0.583 | 0.362 | 76% |

Initial sheet length = 5 inches
Initial sheet width = 4.125 inches
Number of sheets in roll = 90
Dry basesheets basis weight = 65 gsm
Target solution add-on = 225%
Calculated roll weight = 253 grams
Assumed wet thickness prior to winding = 0.48 mm
Compression factor = calculated effective thickness (wound)/assumed wet thickness prior to winding
Calculated Roll Density = weight/$\pi d^2/4$ × width (calculated roll weight/$\pi$ · measured diameter$^2$/4 · initial sheet width)
Calculated Effective Thickness - calculated thickness of sheet in roll under pressure of winding.

TABLE IV

Theoretical Roll Density Possibilities

| Dry Basesheet Weight (gsm) | Solution Add-on (%) | Calculated Roll Weight (grams) | Assumed Pre-wound Wet Thickness (mm) | Assumed Compression Factor (%) | Calculated Roll Diameter (inches) | Calculated Roll Density (g/cm^3) | Footnote |
|---|---|---|---|---|---|---|---|
| 65 | 225 | 253 | 0.48 | 1.300 | 3.75 | 0.34 | (1) |
| 65 | 225 | 253 | 0.48 | 1.150 | 3.53 | 0.38 | |
| 65 | 225 | 253 | 0.48 | 1.000 | 3.29 | 0.44 | (2) |
| 65 | 225 | 253 | 0.48 | 0.900 | 3.12 | 0.49 | |
| 65 | 225 | 253 | 0.48 | 0.800 | 2.94 | 0.55 | |
| 65 | 225 | 253 | 0.48 | 0.710 | 2.77 | 0.62 | (3) |
| 65 | 225 | 253 | 0.48 | 0.600 | 2.55 | 0.73 | |
| 65 | 225 | 253 | 0.48 | 0.500 | 2.33 | 0.88 | (4) |
| 65 | 225 | 253 | 0.48 | 0.440 | 2.18 | 1.00 | |
| 65 | 225 | 253 | 0.48 | 0.405 | 2.09 | 1.09 | (5) |
| 65 | 300 | 311 | 0.48 | 1.300 | 3.75 | 0.42 | |
| 65 | 300 | 311 | 0.48 | 1.150 | 3.53 | 0.47 | |
| 65 | 300 | 311 | 0.48 | 1.000 | 3.29 | 0.54 | |
| 65 | 300 | 311 | 0.48 | 0.900 | 3.12 | 0.60 | |
| 65 | 300 | 311 | 0.48 | 0.800 | 2.94 | 0.68 | |
| 65 | 300 | 311 | 0.48 | 0.700 | 2.75 | 0.77 | |
| 65 | 300 | 311 | 0.48 | 0.600 | 2.55 | 0.90 | |
| 65 | 300 | 311 | 0.48 | 0.500 | 2.33 | 1.08 | |
| 50 | 225 | 195 | 0.48 | 1.300 | 3.75 | 0.26 | |
| 50 | 225 | 195 | 0.48 | 1.150 | 3.53 | 0.29 | |
| 50 | 225 | 195 | 0.48 | 1.000 | 3.29 | 0.34 | |
| 50 | 225 | 195 | 0.48 | 0.800 | 2.94 | 0.42 | |
| 50 | 225 | 195 | 0.48 | 0.600 | 2.55 | 0.56 | |
| 50 | 225 | 195 | 0.48 | 0.400 | 2.08 | 0.85 | |
| 50 | 225 | 195 | 0.48 | 0.313 | 1.84 | 1.08 | |
| 50 | 150 | 150 | 0.48 | 1.300 | 3.75 | 0.20 | (6) |
| 50 | 150 | 150 | 0.48 | 1.000 | 3.29 | 0.26 | |
| 50 | 150 | 150 | 0.48 | 0.800 | 2.94 | 0.33 | |
| 50 | 150 | 150 | 0.48 | 0.600 | 2.55 | 0.43 | |
| 50 | 150 | 150 | 0.48 | 0.400 | 2.08 | 0.65 | |

TABLE IV-continued

Theoretical Roll Density Possibilities

| Dry Basesheet Weight (gsm) | Solution Add-on (%) | Calculated Roll Weight (grams) | Assumed Pre-wound Wet Thickness (mm) | Assumed Compression Factor (%) | Calculated Roll Diameter (inches) | Calculated Roll Density (g/cm^3) | Footnote |
|---|---|---|---|---|---|---|---|
| 50 | 150 | 150 | 0.48 | 0.300 | 1.80 | 0.87 | |
| 50 | 150 | 150 | 0.48 | 0.240 | 1.61 | 1.09 | |

Initial sheet length = 4.5 inches
Initial sheet width = 4.125 inches
Number of sheets in roll = 100
Total roll length = 37.5 feet
Footnotes - Table IV
(1) A very loose roll, no compression, lots of air spaces, giving an overall low density
(2) A roll that theoretically has no compression; this density and volume for roll vs. unrolled would be equal
(3) A roll that has been produced, with this compression and roll density
(4) Estimate of maximum compression achievable before product failure from in-wound tension exceeding strength of sheets or perforations
(5) Physical limitation of the maximum density achievable based on incompressibility of water
(6) Low end density achieved by a loose roll, low dry basis weight and low % Add-on The dispensing force should be ideally considerably less than the detach force for a roll of perforated wipes. In this way it is assured that the wipes will be able to be pulled from, or removed from, the dispenser without inadvertently breaking the perforation. Thus, a dispensing force of from about 100 g to about 600 g is contemplated, a dispensing force of from about 150 g to 250 g is further contemplated and ideally a dispensing force of less than 200 g is desirable, with forces based on g/4.25 inches (g/108.0 mm). Normalized, these forces are 23.5 g/inch (0.93 g/mm) to 141.2 g/inch (5.56 g/mm), 35.3 g/inch (1.39 g/mm) to 58.8 g/inch (2.32 g/mm), and 47.1 g/inch (1.85 g/mm).

Generally a peel force of from 80 g–300 g (per 4.25 inches, 108.0 mm) is contemplated, although lower peel forces may be obtained with different types of wipe products. The cartridge adds minimal resistance to the roll as it is unwound. Thus, the force required to unwind a roll is not materially increased by the cartridge. The roll or stack of wipes may also be placed directly in the tray for dispensing, without the use of a cartridge.

FIG. 19 shows the roll 34 as it is placed in a cartridge in a dispenser.

The spiral line 38 is intended to represent the manner in which the roll is wound and depicts in that configuration a roll that is being unwound from the bottom. That figure further shows the relationship of the wiper 10 to the wet web. FIG. 20 shows the roll 34 in cartridge 11, with spiral line 38 indicating the wind of the roll. This figure shows the relationship of the roll and the ribs 32. As can be seen from this figure the roll is lifted off of the side and bottom walls of the cartridge by rib 32. Thus, the amount of surface area of the roll that is in contact with the cartridge is reduced. This in turn reduces the drag that the roll experiences from friction with the cartridge when the roll is turned.

FIG. 21 shows a portion of a cartridge 11, the lip 31 of the cartridge, and the side walls 39 and 40. The angle at which the cartridge is positioned has an effect on how well the dispenser will perform. The angle will have a tendency to increase or reduce the drag associated with pulling the wipe out. It will have an effect on the amount of siphoning, wicking or drying that may take place in the wet wipe. It may also have an effect on how the roll acts as it is unwound, becoming smaller and smaller in the cartridge. The angle of the cartridge can be measured by the angle that the lip 31 forms with a true vertical axis, shown as 42. For a dispenser system as shown in FIGS. 1–19, the angle 43 that the lip 31 has with a true vertical axis 42 should be from about 10 degrees to about 80 degrees, from about 20 degrees to about 70 degrees, at least greater than 20 degrees, at least smaller than 60 degrees, and preferably about 30 degrees.

Further the angle may be selected such that it balances the forces between the peel forces associated with unrolling the roll and the weight of the roll forcing it down against the ribs. Thus the wipe can be unrolled without having excessive movement of the roll within the cartridge, which in turn overcomes the tendency of the roll to translate toward the gap and bind or jam the dispenser. Additionally, the selection of the angle may play a role in reducing the drying of the wet wipe. As the angle 43 is increased the difference between the height of the top of the roll and the tail is decreased, thus decreasing any siphoning driving force.

FIGS. 22 through 25 show various views of an example of a cover. In this example the cover 7 has cover mounts 29, a recess 5 for forming part of a finger hold indentation, an inside rim 33, which has a top inside rim section 45 and side inside rim sections 46 (of which only one can be seen in FIG. 24), leg sections 72, and posts 44. In this example the posts are used to connect the wiper to the cover.

FIGS. 26 through 28 show an example of a tray 3*a*. In this example the tray has an opening 15*a* with 3 recesses on both sides. The tray has guides that are rollers 47.

In a further example of the tray, the tray is fixed to the housing. This may be accomplished by having the housing and tray being made out of a single piece of material or having the housing and tray joined together by a permanent bonding means, such as welding, heat bonding or gluing. In yet a further example the tray may be attached to the housing so that is cannot rotate with respect to the housing, yet still may be removable.

FIG. 29 shows the rollers 47 used in the tray 3*a* shown FIGS. 26–28. The rollers have raised surfaces 67 and lowered surfaces 68. The raised and lowered surfaces of the rollers as well as any guide may also be a ridge or a rim. As the raised or lowered surfaces become narrower, i.e., become sharper, care must be taken not to cut the wet web.

Wiper blades may be made out of any flexible material, such as thermoplastic elastomers, foam, sponge, plastic, or rubber having a shore A durometer hardness value ranging about 0 to 80, from about 15 to about 70 and preferably from about 30 to about 60. It is further preferred that the wiper blades be made from a material that will form a good moisture and contamination barrier. Examples of preferred types of material are SANTOPRENE®, Kraton®, silicone, or styrene ethylene/butylene styrene (SEBS). The wiper blade is designed to function with the guides and the tray and to a limited extent the lip of the cartridge. Depending on the placement of the wiper, it could have greater or lesser interaction with these components of the dispensing system. The gap between the end of the wiper blade and the tray may be varied depending upon the thickness of the wet wipes and how much drag is need for the dispensing system to function as desired. The wiper blade can help to hold the tail of the wipe in place and thus keep the tail from falling back through the gap and into the cartridge. The wiper blade material has a Gurley stiffness value (ASTM D 6125-97) between about 100 mg and 8000 mg, preferably between about 200 mg and 6000 mg, and more preferably between about 400 mg and 3000 mg.

The force applied to the wipe by the wiper blade when pulling the wipe from the dispenser should not be greater than the tensile strength of the wipe in the non-perforated region and not greater than the perforation tensile strength of a perforated wipe. If the wipes are made such that they are dry in storage and become wet during use, the blade may be configured to exert pressure on the wipe. In this case, the dispensing of a sheet or sheets causes sufficient shear to be applied to the wipe to permit the moisture to be released. For example, this force or shear may be sufficient to cause microcapsules of fluid to burst or may be sufficient to rupture a protective emulsion which contains the fluid.

FIGS. 32 through 37 show an example of a wiper assembly. In this example the wiper assembly 10 comprises a chassis 48, and a blade 50 that has fingers 49. In this example the fingers are designed to cooperate with the lowered surfaces 16*b* (FIG. 2A) of the guides on the housing. In this example the blade is made of SANTOPRENE® and the chassis is made of polypropylene.

FIGS. 38 through 39 show an example of a wiper blade. In this example the wiper blade is formed of a single piece (see FIG. 38) of material that is folded over to form the wiper blade (see FIG. 39). The wiper blade has raised portions 51 that reduce the amount of surface area of the wiper blade that contacts the sheet and raised areas 53 and lowered areas 52 that cooperate with the raised and lowered areas of the guides.

FIGS. 62 to 65 illustrate dispensers 1 that have a rounded member 95 or rounded ridges 96. These components are shown as being part of or attached to the wiper blade assembly 99 and adjacent the wiper blade 74. These components prevent or reduce the tendency of the roll from binding in the gap as the size of the roll decreases.

FIGS. 57 through 61 show an example of a wiper assembly. In this example the wiper comprises a chassis 73, and a wiper blade 74 (74*a* shows sections of blade engaging and protruding through the chassis) that has fingers 75. In this example the fingers are designed to cooperate with the lowered surfaces of the guides 16 in the dispenser. In this example the blade is made of SANTOPRENE® and the chassis is made of polypropylene. This embodiment contains raised or thicker areas 97 of the wiper. These raised areas cooperate with the guides 16 on the tray.

FIGS. 40 through 41 show an example of a roller bar for toilet tissue. This example comprises a first roller housing 80, a second roller housing 81 and a spring 82. FIGS. 55 through 56 show other embodiments of the dispenser.

Figure 44:
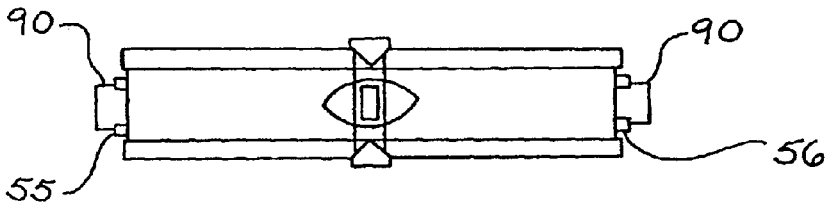
Figure 45:
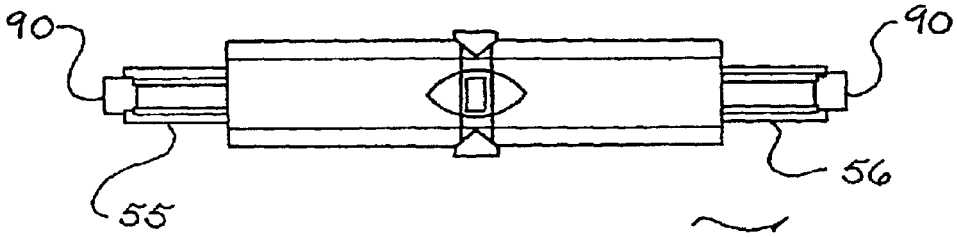
Figure 43:
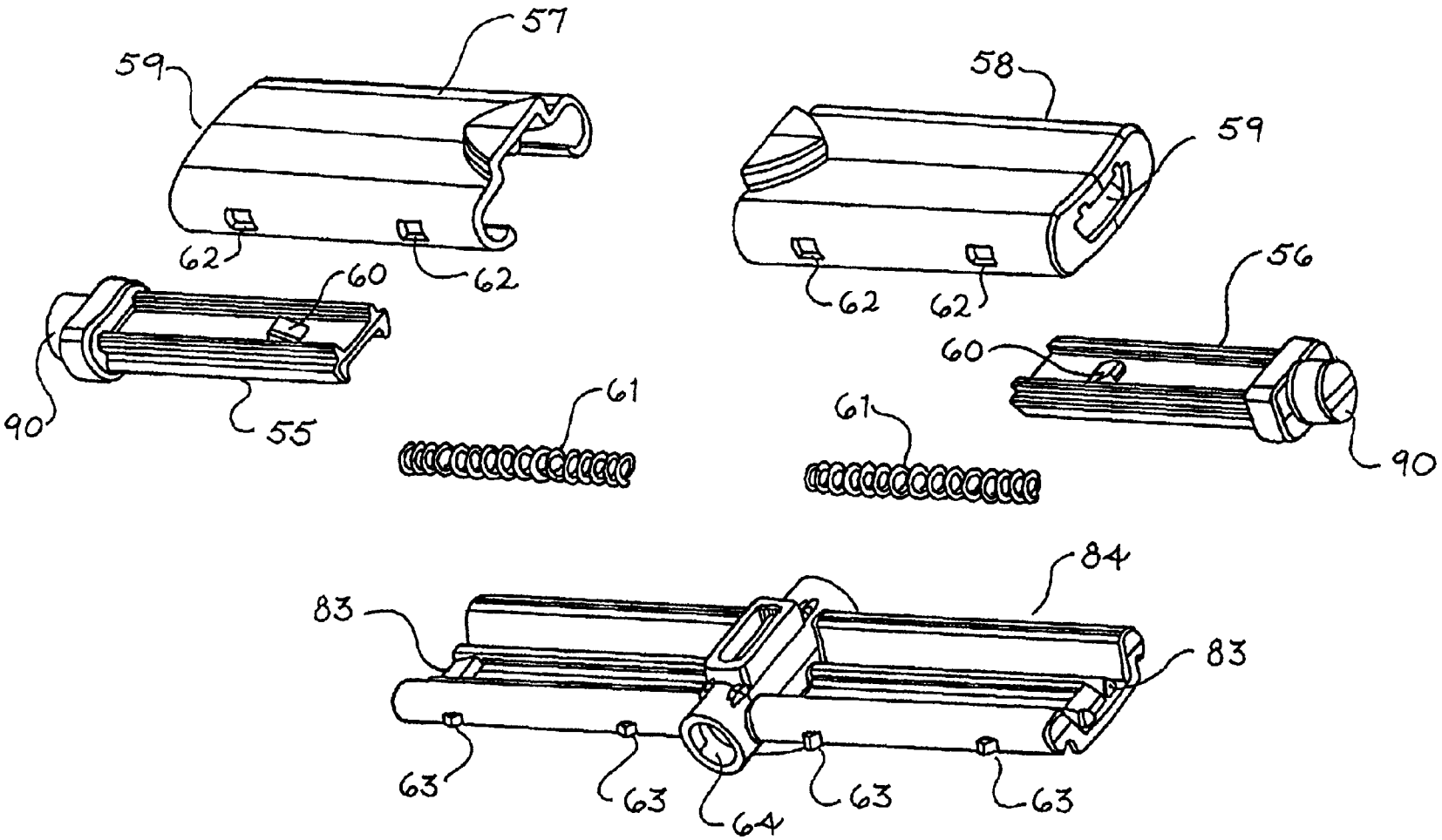

FIGS. 42 through 45 show an example of a mounting assembly. This mounting assembly comprises slide arms 55 and 56, housings 57 and 58, end openings 59, and springs 61. The slide arms have stops 60 that cooperate with stops 83 to limit the maximum longitudinal extension of the slide arms. The mounting assembly has a third housing 84 that has tabs 63 that cooperate with openings 62 to secure the housings 57 and 58 to housing 84. Housing 84 further has a threaded passage 64 for receipt of a screw. FIG. 44 shows the mounting assembly with the slide arms in a retracted position, while FIG. 45 shows the mounting assembly with the slide arms in an extended position. In one embodiment, the length of the mounting assembly in the retracted position is about 3.5 inches (88.9 mm), and the length of the mounting assembly in the extended position the length is about 8 inches (203.2 mm). Preferably the length of the mounting assembly in the retracted position is about 5 inches (127.0 mm), and the length of the mounting assembly in the extended position the length is about 6.5 inches (165.1 mm). The three housing design may also be simplified into a two housing embodiment or a single housing embodiment. In the two housing embodiment, top and bottom or side and side halves are fixed together to hold the spring and slide arms.

The assembly is held in place by having the ends out the side arms positioned in holes in the object that the dispenser is to be attached to, for example the holes in a toilet paper dispenser mounted into a wall. The springs keep the slide arms extended and thus hold them in the holes. A screw is then inserted through the dispenser and the passage 64 and tightened down, forcing the end engagement surfaces 90 against the wall of the holes in the toilet tissue dispenser.

FIG. 66 depicts a conventional bath tissue holder 85 that is the partially recessed type, having posts 86. FIG. 67 depicts a conventional bath tissue holder 85 that is not recessed and having posts 86 and a roller 6. FIG. 68 illustrates the holder of FIG. 67 with the roller removed and a mounting assembly 8 engaged with the post 86. In actual use the mounting assembly would be joined with a dispenser, as shown for example in FIG. 2.

The mounting assembly should be made out of material that is strong enough to withstand the forces that are placed on it to hold the dispenser in place. The material should have enough strength to withstand the forces that the screw will place on the treaded passage. Examples of materials that may provide these features and be used to make the mounting assembly are 15% or more glass filled Pbt, ABS or any material having similar strength properties.

FIGS. 46 to 50 show an example of a screw 9 that cooperates with a mounting device, such as the example shown in FIGS. 42–45. The screw should be made of material that meets the same strength requirements as set out for the mounting assembly. In this example the screw has a thread design that requires 6 turns to move it 1 inch (25.4 mm). Standard ACME conventional screw threads require 23 turns to move it 1 inch (25.4 mm). This thread design provides greater ease for the user to attach the dispenser because it requires less turns of the screw to do so. In this example the screw additionally has a large head, with a groove 65 and grips 66. The groove can fit a coin or screwdriver. The larger head of the screw and the groove, however, are not necessary, although they may be preferred to provide greater ease to install the dispenser system. The screw may further be provided with a lock nut or jam nut near the head to prevent loosening of the screw after it is tightened.

Alternative mountings may also be employed. These mountings may be fixed or removable. They may include by way of example such fastening systems as cable ties, wing nuts, anchor bolts, click and grooves and snap and lock mechanisms.

FIGS. 51–53 show an example of a cartridge. In this example the cartridge has protrusions 69 on its side walls.

FIG. 54 shows an example of a package of cartridges. In use this package would be filled with rolls of wet wipes, one for each cartridge. The cartridges would than be sealed, by placing a totally or partially removable cover over the lips 31. The seal is preferably moisture and bacterial resistant. The consumer would then purchase the package and remove a cartridge, open the dispenser and place the cartridge in the dispenser. The top of the cartridge or the slit in the cover can be removed either before placing the cartridge in the dispenser or after it is inserted in the dispenser. The end of the roll of wet wipes is then pulled out and over the tray and guides and the cover is then closed, thus providing an efficient system for dispensing wet wipes.

We claim:

1. A method for providing a wet wipes dispenser comprising:

obtaining a wet wipes dispenser, the dispenser comprising a tray, a wiper, and an interior; the tray situated in the interior;

determining that the tray can be removed from the dispenser;

determining the dimensions of the interior;

manufacturing a container for wipes based on the dimensions;

providing a plurality of wipes for the container;

providing instruction to remove the tray from a second dispenser and to place the container in the interior of the second dispenser;

determining that the tray comprises at least one pin, and that the dispenser comprises an opening; the opening and the pin mating together to mount the tray to the dispenser; and determining the dimensions and placement of the pin;

wherein the container comprises at least one pin having dimensions and placement which are substantially the same as the dimensions and placement of the obtained pin.

2. The method of claim 1, wherein the container comprises a bacterial resistant seal.

3. A method for providing a wet wipes dispenser comprising:

obtaining a wet wipes dispenser, the dispenser comprising a tray, a wiper, and an interior; the tray situated in the interior;

determining that the tray can be removed from the dispenser;

determining the dimensions of the interior;

manufacturing a container for wipes based on the dimensions;

providing a plurality of wipes for the container;

providing instruction to remove the tray from a second dispenser and to place the container in the interior of the second dispenser;

determining that the tray comprises at least one pin, and that the dispenser comprises an opening; the opening and the pin mating together to mount the tray to the dispenser;

determining the dimensions and placement of the pin; and manufacturing a manufactured tray comprising at least one pin having dimensions and placement which are substantially the same as the dimensions and placement of the pin; wherein the container can be placed in the tray; and providing instruction to mount the manufactured tray in the interior of the second dispenser.

4. A method for providing a wet wipes dispenser comprising:

obtaining a wet wipes dispenser, the dispenser comprising a tray, a wiper, and an interior; the tray situated in the interior;

determining that the tray can be removed from the dispenser;

determining the dimensions of the interior;

manufacturing a container for wipes based on the dimensions;

providing a plurality of wipes for the container;

providing instruction to remove the tray from a second dispenser and to place the container in the interior of the second dispenser;

determining that the wiper can be removed from the dispenser;

providing instruction to remove the wiper from the dispenser;

determining that the wiper comprises at least one opening, and that the dispenser comprises a post; the post and the opening mating together to mount the wiper to the dispenser;

determining the dimensions and placement of the opening;

manufacturing a manufactured wiper comprising at least one opening having dimensions and placement which are substantially the same as the dimensions and placement of the obtained opening; and providing instruction to mount the manufactured wiper to the second dispenser.

* * * * *